US007175955B2

(12) United States Patent
Yao et al.

(10) Patent No.: US 7,175,955 B2
(45) Date of Patent: Feb. 13, 2007

(54) ELECTROPHOTOGRAPHIC PHOTORECEPTOR, ELECTROPHOTOGRAPHIC PROCESS CARTRIDGE AND IMAGE FORMING APPARATUS

(75) Inventors: Kenji Yao, Minamiashigara (JP); Masahiro Iwasaki, Minamiashigara (JP); Katsumi Nukada, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/745,699

(22) Filed: Dec. 29, 2003

(65) Prior Publication Data

US 2005/0002692 A1 Jan. 6, 2005

(30) Foreign Application Priority Data

Jun. 30, 2003 (JP) ..... 2003-187435
Jul. 1, 2003 (JP) ..... 2003-189738
Jul. 1, 2003 (JP) ..... 2003-189739

(51) Int. Cl.
*G03G 5/047* (2006.01)
*G03G 5/05* (2006.01)

(52) U.S. Cl. ..... 430/58.2; 430/58.65; 430/58.8; 430/59.6; 430/66; 430/96; 399/116; 399/159

(58) Field of Classification Search ..... 430/59.6, 430/96, 58.65, 58.8, 59.1, 58.2, 66, 67; 399/116, 399/159, 58.2, 66.67
See application file for complete search history.

(56) References Cited

U.S. PATENT DOCUMENTS 4,766,048 A * 8/1988 Hisamura ..... 430/58.05
4,933,245 A * 6/1990 Akasaki et al. ..... 430/58.8
5,744,271 A * 4/1998 Aizawa et al. ..... 430/59.6
6,183,921 B1 * 2/2001 Yu et al. ..... 430/58.7
6,352,809 B1 * 3/2002 Nukada et al. ..... 430/127
6,824,939 B2 * 11/2004 Kurimoto et al. ..... 430/66
6,884,556 B2 * 4/2005 Kumano et al. ..... 430/96

FOREIGN PATENT DOCUMENTS

JP A 1-246580 10/1989
JP A 6-75391 3/1994
JP A 8-123049 5/1996
JP 09-043882 * 2/1997
JP 2002-351113 * 12/2002
JP A 2003-43817 2/2003

OTHER PUBLICATIONS

Japanese Patent Office machine-assisted translation of JP 09-043882 (pub. Feb. 1997).*
Japanese Patent Office machine-assisted translation of JP 2002-351113 (pub. Dec. 2002).*
English-language translation of JP 2002-351113 (pub. Dec. 2002).*

* cited by examiner

*Primary Examiner*—Janis L. Dote
(74) *Attorney, Agent, or Firm*—Oliff & Berridge, PLC

(57) ABSTRACT

An electrophotographic photoreceptor comprising a conductive substrate, and at least one layer, which contains a polymeric compound having a repeating unit selected from repeating units represented by the following general formulas (I) to (III), provided on the conductive substrate, as well as an electrophotographic process cartridge and an image forming apparatus using the electrophotographic photoreceptor.

(I)

(II)

(III)

In general formulas (I) to (III), $R_{1a}$ and $R_{1b}$ each independently represent an alkylene group, X represents an arylene group or an alkylene group, Y represents a divalent aromatic group, and n represents a repeating unit number.

18 Claims, 2 Drawing Sheets

ELECTROPHOTOGRAPHIC PHOTORECEPTOR, ELECTROPHOTOGRAPHIC PROCESS CARTRIDGE AND IMAGE FORMING APPARATUS

CROSS-REFERENCE TO RELATED APPLICATION

This application claims priority under 35 USC 119 from Japanese Patent Application Nos. 2003-187435, 2003-189738 and 2003-189739, the disclosures of which are incorporated by reference herein.

BACKGROUND OF THE INVENTION

1. Field of the Invention

The present invention relates to an electrophotographic photoreceptor, an electrophotographic process cartridge and an image forming apparatus and, more particularly, to an electrophotographic photoreceptor which has high wear resistance and high heat resistance and also exhibits low torque to a cleaning blade, and an electrophotographic process cartridge and an image forming apparatus using the same.

2. Description of the Related Art

Heretofore, polycarbonates have widely been used as a binder resin which is applied to a surface layer and a charge transport layer of a multi-layer type electrophotographic photoreceptor comprising plural functional layers which are mutually laminated. Among these polycarbonates, bisphenol Z type polycarbonate has occupied on important position as a binder resin for a charge transport layer because of its high solubility in various organic solvents in the preparation of a coating solution as well as its comparatively excellent mechanical strength and electrical characteristics for a charge transport layer, as described in Japanese Patent Application Laid-Open (JP-A) No. 1-246580.

JP-A No. 6-75391 reports an attempt to apply a bisphenol A type polycarbonate and various modified polycarbonates, which were inferior in solubility in an organic solvent in the prior art, for the purpose of extending the lifetime of an electrophotographic photoreceptor. Also JP-A No. 2003-43817 reports an attempt to apply various polyallylates which were inferior in electrical characteristics. JP-A No. 8-123049 reports an attempt to improve solubility by copolymerizing a polycyclic aromatic polycarbonate, which is only slightly soluble in a solvent, with a bisphenol type polycarbonate.

However, high image quality equivalent to that of printing has recently been required in electrophotography, and since cleaning has been intensified in order to completely remove deposits and residual toners on an electrophotographic photoreceptor, a surface layer of the electrophotographic photoreceptor requires higher wear resistance and lower torque than those of the prior art. Thus, it has become impossible to satisfy these requirements using the prior art. With size reduction of printers, a distance between the electrophotographic photoreceptor and a heat-generating unit such as a fixing device has decreased. Thus higher heat resistance is required of the electrophotographic photoreceptor, and it has become impossible to satisfy higher heat resistance using the prior art.

With regard to polycarbonate, a toxic substance such as phosgene is used as a synthetic raw material thereof, and thus improvement of the process is required. Since a large amount of an organic solvent is used to prepare a coating solution of the polycarbonate, the organic solvent must be disposed of, which is not preferable. Molecular design for increasing the mechanical strength of polycarbonate increases the hardness, but also makes the polycarbonate brittle. Thus solvent cracks may occur when the electrophotographic photoreceptor containing the molecular designed polycarbonate is used for a long period.

Further, in the manufacture of the electrophotographic photoreceptor, a solution prepared by dissolving a functional material in an organic solvent is often applied by a dip coating method or a spray coating method. The use of a large amount of the organic solvent increases environmental burden.

SUMMARY OF THE INVENTION

A first object of the present invention is to provide an electrophotographic photoreceptor which has high wear resistance and high heat resistance, causes no solvent cracks, and also exhibits low torque to a cleaning blade, an electrophotographic process cartridge using the same, and an image forming apparatus capable of forming an image having high image quality.

A second object of the invention is to provide an electrophotographic photoreceptor which has high wear resistance and high heat resistance and exhibits low torque to a cleaning blade, and an electrophotographic process cartridge and an image forming apparatus using the same.

A third object of the invention is to provide an electrophotographic photoreceptor which has high wear resistance and high heat resistance, exhibits low torque to a cleaning blade, and is also capable of decreasing the usage amount of an organic solvent, an electrophotographic process cartridge using the same, and an image forming apparatus capable of forming an image having high image quality.

The above objects can be achieved by the following means.

(1) An electrophotographic photoreceptor comprising a conductive substrate, and at least one layer, which contains a polymeric compound having a repeating unit selected from repeating units represented by the following general formulas (I) to (III), provided on the conductive substrate.

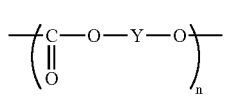

(I)

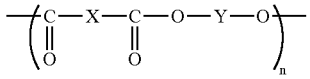

(II)

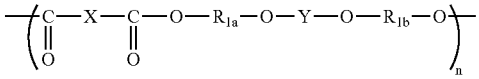

(III)

In general formulas (I) to (III), $R_{1a}$ and $R_{1b}$ each independently represent an alkylene group having 1 to 6 carbon atoms, X represents a substituted or unsubstituted arylene group, or a substituted or unsubstituted alkylene group, Y represents at least one selected from the group of structures represented by the following general formulas (IV) to (XI), and n represents a repeating unit number.

(IV)

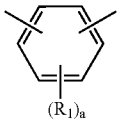

(V)

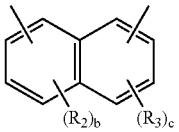

(VI)

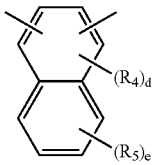

(VII)

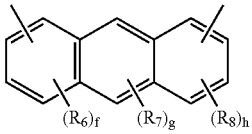

(VIII)

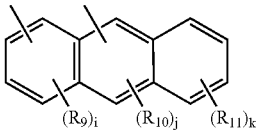

(IX)

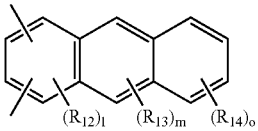

(X)

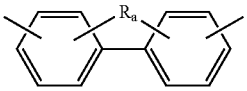

(XI)

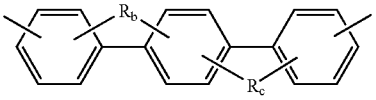

In general formulas (IV) to (IX), $R_1$ to $R_{14}$ each independently represent an alkyl group having 1 to 10 carbon atoms, an aryl group having 6 to 14 carbon atoms, or a substituent containing silicon; a, e, k and o each independently represent an integer from 0 to 4; b, c, f, h and i each independently represent an integer from 0 to 3; d, g, 1 and m each independently represent an integer from 0 to 2; and j represents 0 or 1.

In general formulas (X) and (XI), $R_a$ to $R_c$ each independently represent a substituted or unsubstituted alkylene group having 1 to 10 carbon atoms, or a divalent substituent containing silicon.

Each one of $R_a$, $R_b$ and $R_c$ may be present in a plurality in the respective formulas.

(2) An electrophotographic process cartridge comprising at least the electrophotographic photoreceptor according to (1).

(3) An image forming apparatus comprising the electrophotographic photoreceptor according to (1), charging means for uniformly charging the electrophotographic photoreceptor, latent image forming means for forming a latent image on a surface of the charged electrophotographic photoreceptor, developing means for developing the latent image formed on the surface of the electrophotographic photoreceptor with a developer containing at least a toner to form a toner image, transferring means for transferring the toner image formed on the surface of the electrophotographic photoreceptor onto a toner image receiving body, and cleaning means for removing residual toner on the surface of the electrophotographic photoreceptor after the toner image has been transferred.

DETAILED DESCRIPTION OF THE INVENTION

Figure 1:
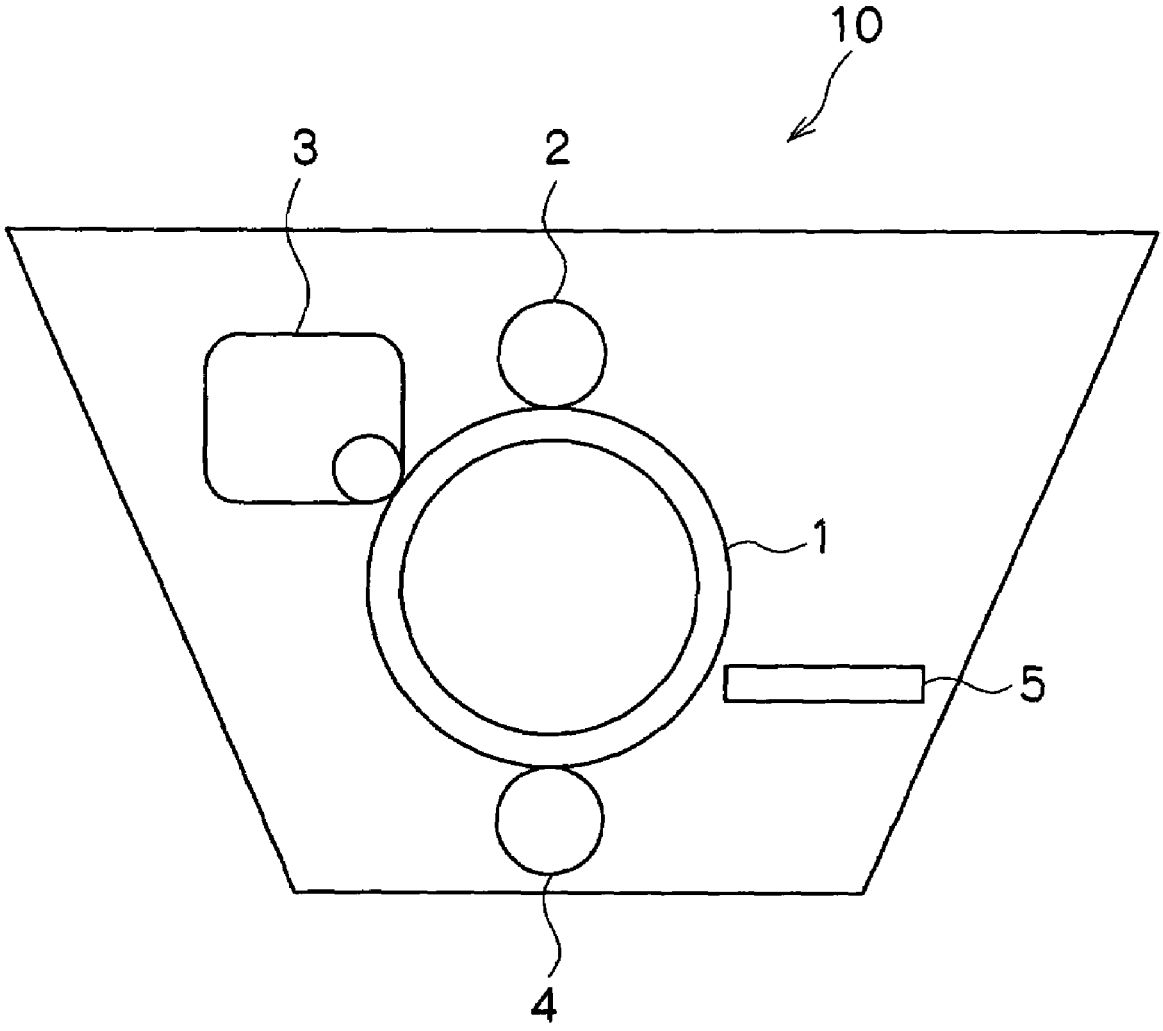
FIG. 1 is a schematic view showing an example of an electrophotographic process cartridge of the present invention.

The electrophotographic photoreceptor, the electrophotographic process cartridge and the image forming apparatus of the present invention will now be described in detail.

<Electrophotographic Photoreceptor>

The electrophotographic photoreceptor of the present invention comprises a conductive substrate, and at least one layer, which contains a polymeric compound having a repeating unit selected from repeating units represented by the following general formulas (I) to (III), provided on the conductive substrate.

(I)

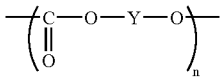

(II)

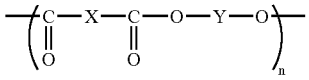

(III)

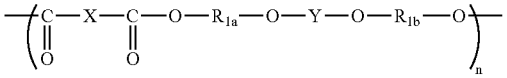

In general formulas (I) to (III), $R_{1a}$ and $R_{1b}$ each independently represent an alkylene group having 1 to 6 carbon atoms, X represents a substituted or unsubstituted arylene group, or a substituted or unsubstituted alkylene group, Y represents at least one selected from the group of structures represented by the following general formulas (IV) to (XI), and n represents a repeating unit number.

(IV)

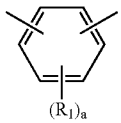

-continued (V)

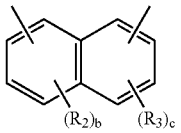

(VI)

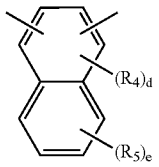

(VII)

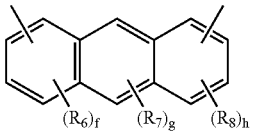

(VIII)

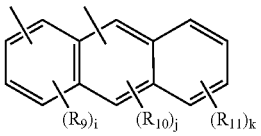

(IX)

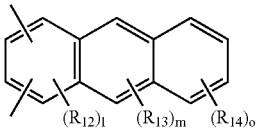

(X)

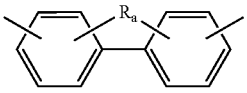

(XI)

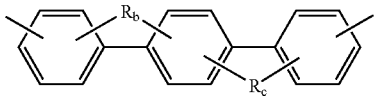

In general formulas (IV) to (IX), $R_1$ to $R_{14}$ each independently represent an alkylene group having 1 to 6 carbon atoms, an aryl group having 6 to 14 carbon atoms, or a substituent containing silicon; a, e, k and o each independently represent an integer from 0 to 4; b, c, f, h and i each independently represent an integer from 0 to 3; d, g, 1 and m each independently represent an integer from 0 to 2; and j represents 0 or 1.

In general formulas (X) and (XI), $R_a$ to $R_c$ each independently represent a substituted or unsubstituted alkylene group having 1 to 10 carbon atoms, or a divalent substituent containing silicon, and each one of $R_a$, $R_b$ and $R_c$ may be present in a plurality in the respective formulas.

The polymeric compound having a repeating unit represented by general formula (I) is easy to handle because of its high solubility in an organic solvent. The electrophotographic photoreceptor of the invention comprising at least one layer containing the polymeric compound having a repeating unit represented by general formula (I) has high wear resistance and high heat resistance, and also exhibits low torque to a cleaning blade.

In the invention, although the polymeric compound having a repeating unit represented by general formula (I) can be used in any functional layer of the electrophotographic photoreceptor, at least one layer of layers containing the polymeric compound having a repeating unit represented by general formula (I) is preferably a charge transport layer.

The polymeric compound having a repeating unit represented by general formula (I) has markedly rigid arylene group structures as shown in general formulas (IV) to (XI). Unlike bisphenols, these structures do not include a rotatable or vibratable bond. Furthermore, since these structures have a lot of aromatic rings, they have high compatibility with a charge transport material, which also have a lot of aromatic rings. By these reasons, when the polymeric compound having a repeating unit represented by general formula (I) is used in the charge transport layer, the charge transport layer preferably exhibits markedly high wear resistance and high heat resistance.

Also the polymeric compound having a repeating unit represented by general formula (I) has good compatibility with the charge transport material having a lot of aromatic rings, and the surface of a charge transport layer containing the polymeric compound having a repeating unit represented by general formula (I) and the charge transport material is a surface with less defects, and exhibits low torque to a cleaning blade, and is also capable of suppressing solvent cracks.

The polymeric compound having a repeating unit represented by general formula (I) does not contain any toxic substance such as halogen and therefore there is less necessity for improving the process to reduce environmental burden.

In the invention, Y in general formula (I) is preferably a p-phenylene group in general formula (IV) or general formula (VII), and more preferably a p-phenylene group in general formula (IV).

n is preferably from 10 to 10000, and more preferably from 20 to 1000.

Specific examples of the polymeric compound having a repeating unit represented by general formula (I) of the present invention will be described below, but the invention is not limited by the following specific examples.

TABLE 1

| No. | Structual Formula |
|---|---|
| I-1 | 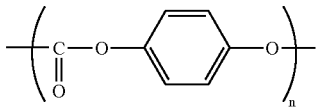 |
| I-2 | 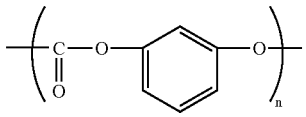 |
| I-3 | 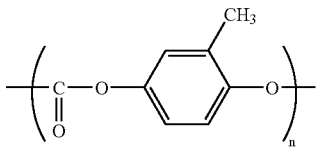 |
| I-4 | 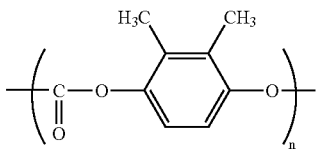 |

TABLE 1-continued
| No. | Structual Formula |
|---|---|
| I-5 | 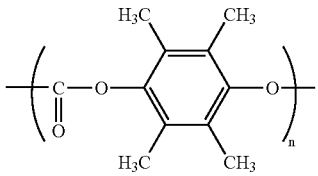 |
| I-6 | 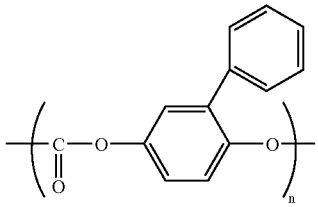 |
| I-7 | 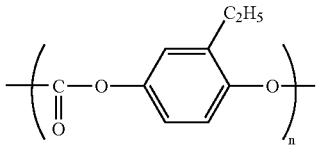 |
| I-8 | 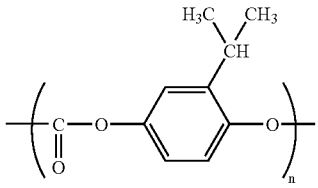 |
| I-9 | 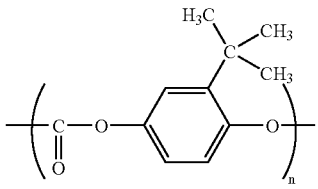 |
| I-10 | 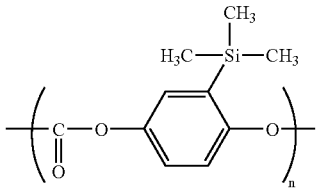 |
| I-11 | 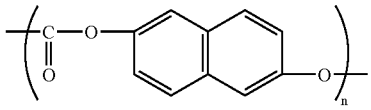 |
| I-12 | 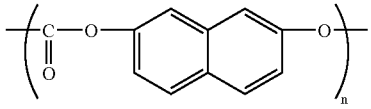 |
| I-13 | 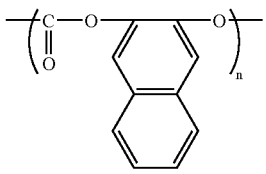 |
TABLE 1-continued
| No. | Structual Formula |
|---|---|
| I-14 | 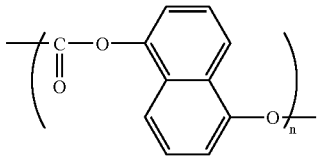 |
| I-15 | 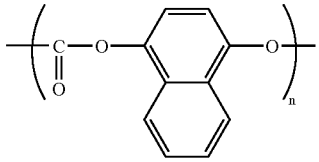 |
| I-16 | 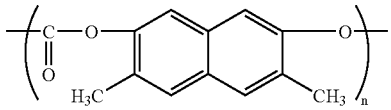 |
| I-17 | 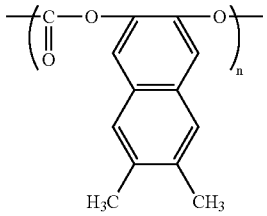 |
| I-18 | 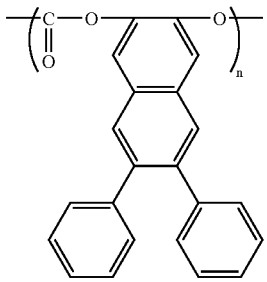 |
TABLE 2
| No. | Structual Formula |
|---|---|
| I-19 | 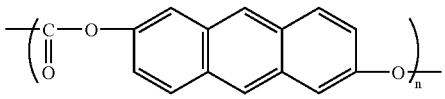 |
| I-20 | 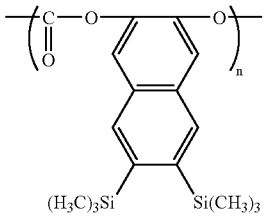 |
| I-21 | 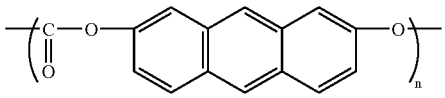 |

TABLE 2-continued

| No. | Structual Formula |
|---|---|
| I-22 | 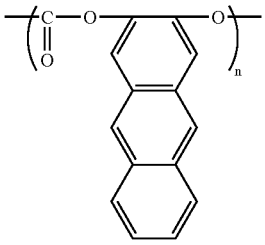 |
| I-23 | 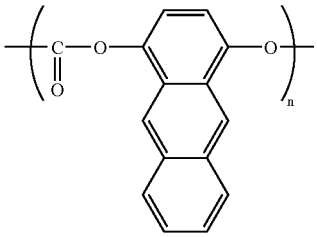 |
| I-24 | 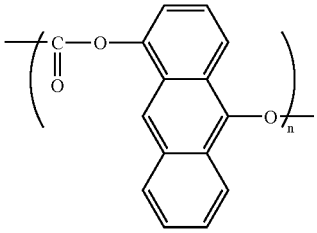 |
| I-25 | 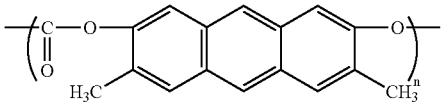 |
| I-26 | 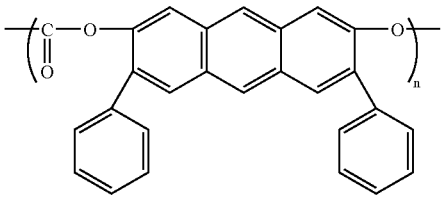 |
| I-27 | 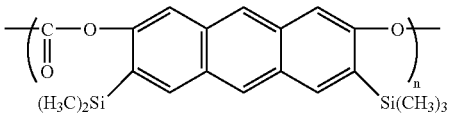 |

The method of producing the polymeric compound having a repeating unit represented by general formula (I) is not specifically limited, and known methods such as melt polycondensation, interfacial polymerization and solution polymerization methods can be used. It is preferable to be prepared by a process for melt polycondensation or solid phase polymerization of at least a diol represented by the following general formula (XII) and diphenyl carbonate because there is less necessity for improving the process to reduce environmental burden.

$$HO—Y—OH \quad (XII)$$

In general formula (XII), Y is as defined in general formula (I).

Polycarbonate, which has conventionally been used as a material for electrophotographic photoreceptor, is produced from phosgene as a raw material by an interfacial polymerization method. However, phosgene is a severe toxic substance and is not suited for use in synthesis of the resin.

Either of the melt polycondensation and solid phase polymerization methods used preferably in the invention is a polymerization method which causes less environmental burden because not only phosgene, but also an organic solvent is not used.

The melt polycondensation method is composed of two steps, for example, a transesterification step and a polymerization reaction step, while a conventionally known technique used in the polymerization of polycarbonate or polyester can be used with regard to catalyst and reaction conditions. Specific examples of the transesterification catalyst include acetates such as calcium acetate, zinc acetate, and manganese acetate; oxides such as zinc oxide; and titanic acids such as tetrabutoxytitanic acid. Examples of the polymerization catalyst include oxides such as germanium oxide, antimony trioxide, and tin dioxide; and titanic acids such as tetrabutoxytitanic acid.

Also in the solid phase polymerization method, a polymerization catalyst for melt polycondensation can be used.

The electrophotographic photoreceptor of the invention, comprising at least one layer containing a polymeric compound having a repeating unit represented by general formula (II) has high wear resistance and high heat resistance, and also exhibits low torque to a cleaning blade.

The polymeric compound having a repeating unit represented by general formula (II) has markedly high mechanical strength because it has a rigid structure of phenyl, naphthalene, anthracene, biphenyl or terphenyl, and an electrophotographic photoreceptor containing the polymeric compound has markedly high wear resistance. In general, the solubility in an organic solvent deteriorates when biphenyl or terphenyl structure is contained. When the phenylene group is substituted with an alkyl substituent to solve this problem, the solubility is improved but the mechanical strength decreases. In the biphenyl or terphenyl structure contained in the polymeric compound having a repeating unit represented by general formula (II), a difunctional group exists in the form of bonding a plurality of phenylene groups, thus making it possible to realize high solubility in an organic solvent without decreasing the mechanical strength.

Furthermore, the polymeric compound having a repeating unit represented by general formula (II) has good compatibility with photosensitive layer functional materials such as charge transport material and charge generation material, each having a lot of aromatic rings, because it has a lot of aromatic rings, and the surface of a charge transport layer containing the polymeric compound having a repeating unit represented by general formula (II) and a charge transport material, or the surface of a charge generation layer containing the polymeric compound having a repeating unit represented by general formula (II) and a charge generation material is a surface with less defects. Therefore, in case the charge transport layer or charge generation layer is a surface layer of the electrophotographic photoreceptor of the invention, the electrophotographic photoreceptor exhibits low torque to a cleaning blade.

Since the polymeric compound having a repeating unit represented by general formula (II) has high solubility, the amount of an organic solvent used in the production of a coating solution can be reduced, and thus achieving less environmental burden.

In the invention, Y in general formula (II) is preferably general formula (IV), (VI), (VII) or (IX), more preferably general formula (IV) or (VII), and particularly preferably general formula (IV).

In the invention, X in general formula (II) is preferably a phenylene group, a naphthylene group, a butylene group or a hexylene group, more preferably a 1,4-phenylene group, a 1,3-phenylene group, a 2,6-naphthylene group, a 2,7-naphthylene group, a 2,3-naphthylene group, an n-butylene group or an n-hexylene group, and particularly preferably a 1,4-phenylene group or a 2,6-naphthylene group.

In the invention, n in general formula (II) is preferably from 10 to 100000, more preferably from 20 to 50000, and particularly preferably form 30 to 10000.

Specific examples of the polymeric compound having a repeating unit represented by general formula (II) of the present invention will be described below, but the invention is not limited by the following specific examples.

TABLE 3

| No. | Structual Formula |
|---|---|
| II-1 | 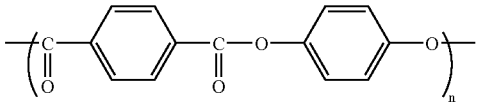 |
| II-2 | 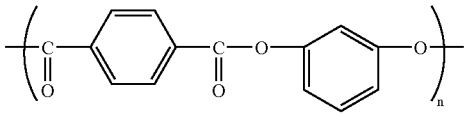 |
| II-3 | 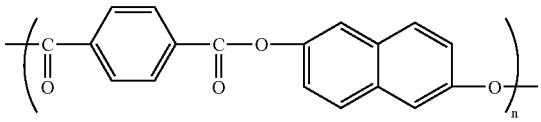 |
| II-4 | 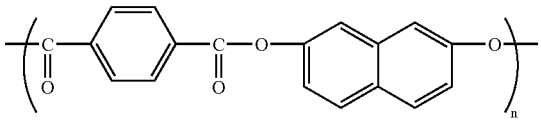 |
| II-5 | 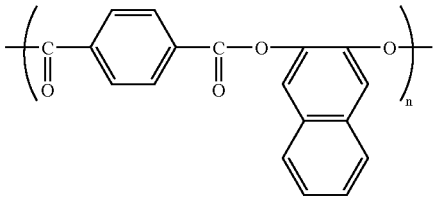 |
| II-6 | 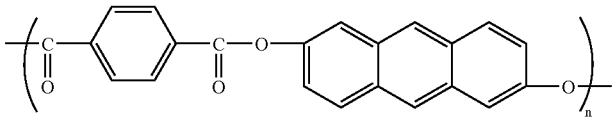 |
| II-7 | 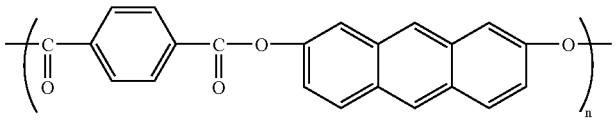 |
| II-8 | 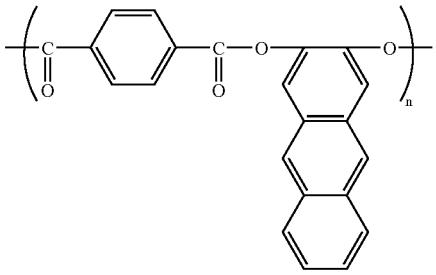 |

TABLE 3-continued
| No. | Structual Formula |
|---|---|
| II-9 | 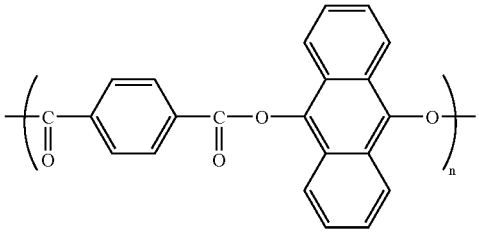 |
TABLE 4
| No. | Structual Formula |
|---|---|
| II-10 | 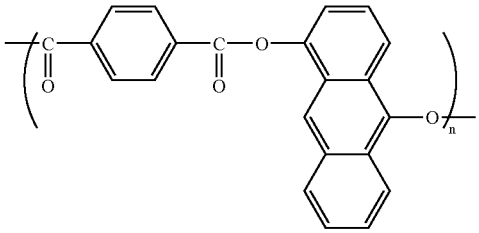 |
| II-11 | 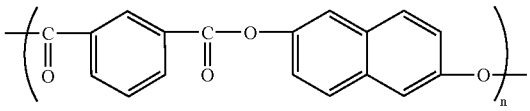 |
| II-12 | 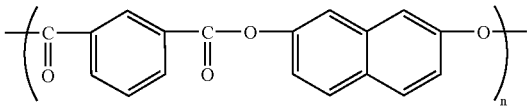 |
| II-13 | 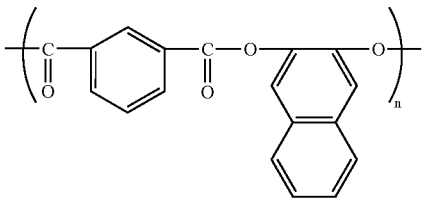 |
| II-14 | 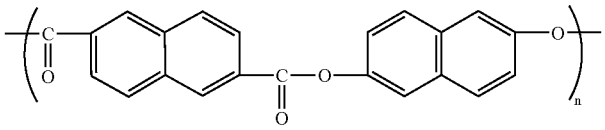 |
| II-15 | 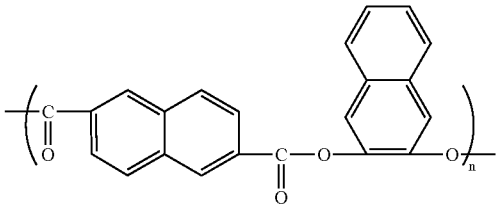 |
| II-16 | 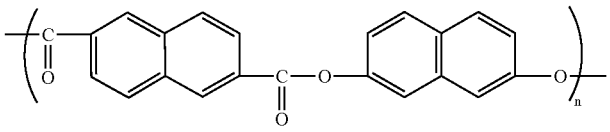 |

TABLE 4-continued
| No. | Structual Formula |
|---|---|
| II-17 | 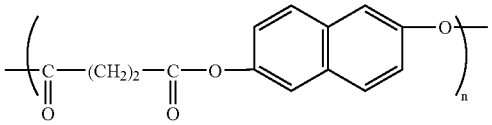 |
| II-18 | 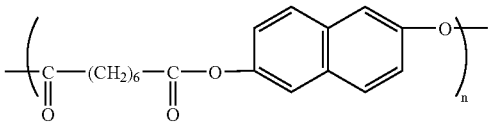 |
TABLE 5
| No. | Structual Formula |
|---|---|
| II-19 | 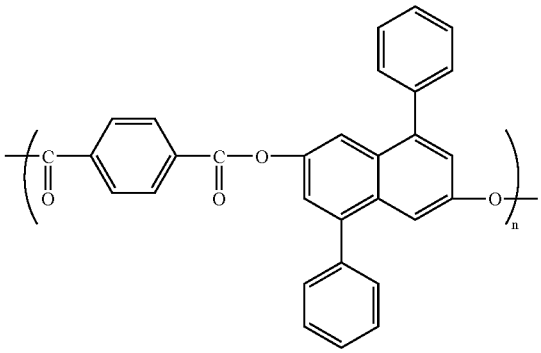 |
| II-20 | 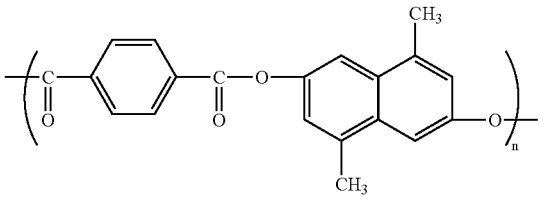 |
| II-21 | 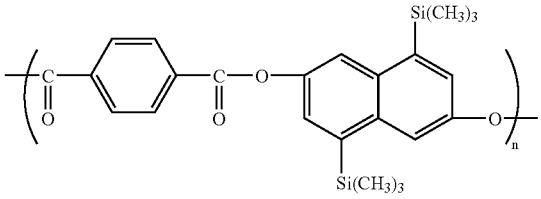 |
| II-22 | 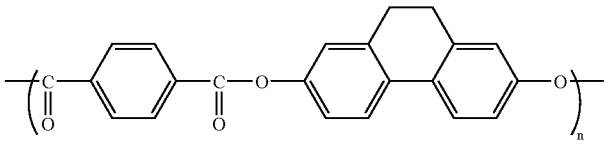 |
| II-23 | 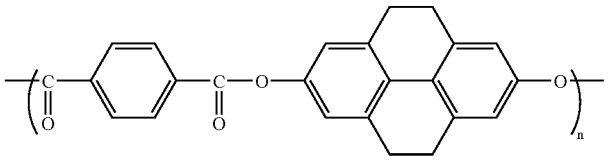 |

TABLE 5-continued
| No. | Structual Formula |
|---|---|
| II-24 | 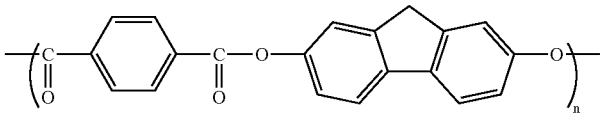 |
| II-25 | 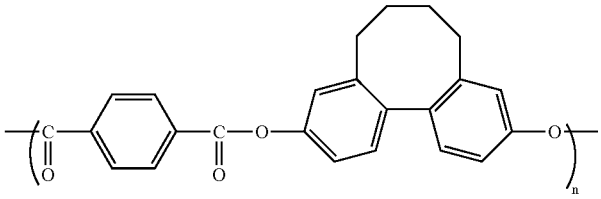 |
TABLE 6
| No. | Structual Formula |
|---|---|
| II-26 | 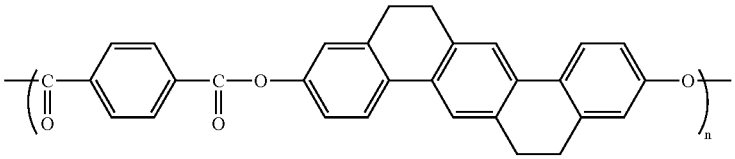 |
| II-27 | 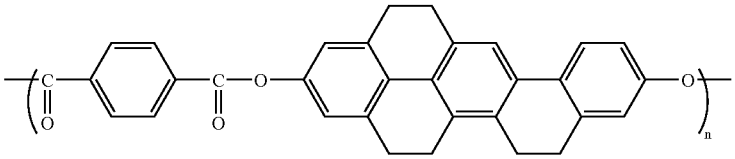 |
| II-28 | 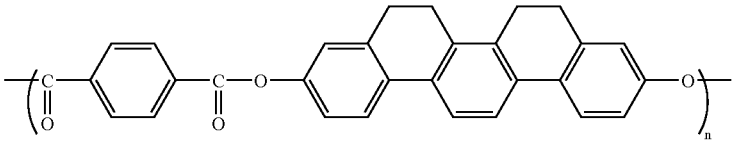 |
| II-29 | 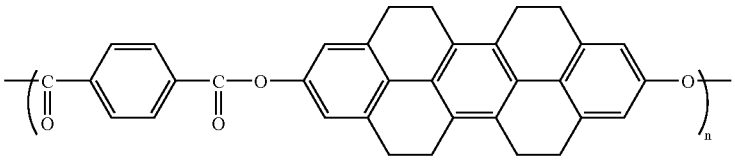 |
| II-30 | 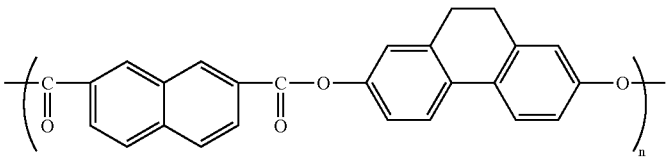 |
| II-31 | 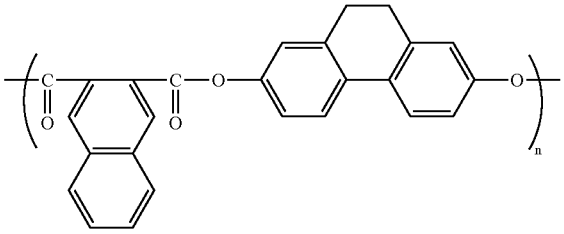 |

TABLE 6-continued

| No. | Structual Formula |
|---|---|
| II-32 | 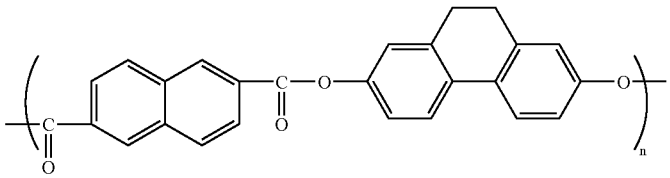 |
| II-33 | 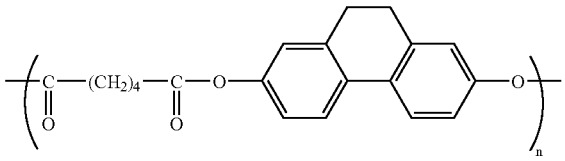 |
| II-34 | 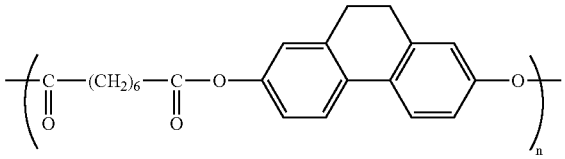 |

TABLE 7

| No. | Structual Formula |
|---|---|
| II-35 | 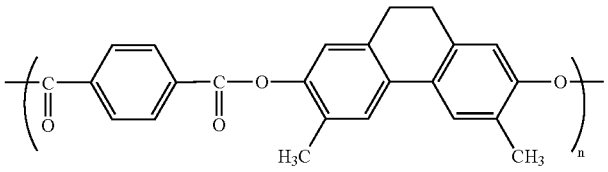 |
| II-36 | 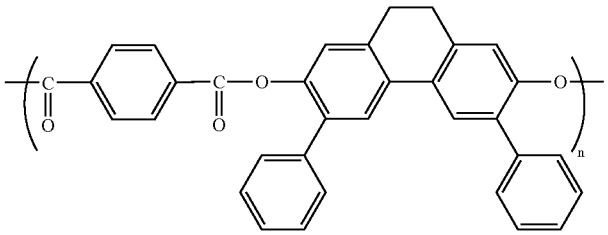 |
| II-37 | 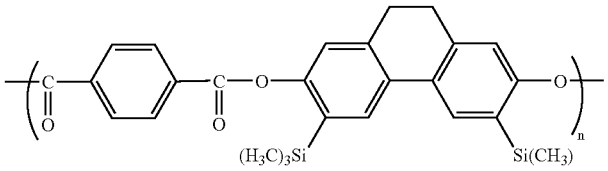 |

The method of producing the polymeric compound having a repeating unit represented by general formula (II) is not specifically limited, and known methods such as interfacial polymerization, solution polymerization and direct polycondensation methods can be used.

In view of the productivity, it is preferable to be prepared by a process for solution polymerization or interfacial polymerization of at least acid chloride represented by the following general formula (XIII) and a diol represented by the following general formula (XIV).

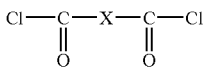

(XIII)

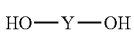

(XIV)

In general formulas (XIII) and (XIV), X and Y are as defined in general formula (II).

The organic solvent and catalyst in the interfacial polymerization are not specifically limited and known organic solvents and catalysts can be used. Specific examples of the organic solvent include tetrahydrofuran, toluene and methyl ethyl ketone, and specific examples of the catalyst include amines such as triethylamine.

In view of environmental burden, it is preferable to be prepared by a process for direct polycondensation of at least dicarboxylic acid represented by the following general formula (XV) and a diol represented by the following general formula (XIV).

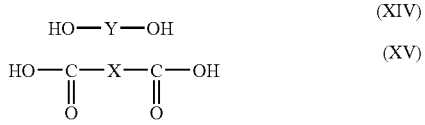

(XIV)

(XV)

In general formulas (XIV) and (XV), X is as defined in general formula (II).

The direct polycondensation method is a method of allowing the reaction to proceed by heating the dicarboxylic acid with the diol in the presence of an activating agent and distilling off an effluent, and also requires a very small amount of the solvent.

Examples of the activating agent include arylsulfonyl chloride-DMF, diphenyl chlorophosphate-DMF, triphenylphosphine dichloride, phosphorus trichloride-pyridine, phosphorus oxychloride-LiCl, and thionyl chloride-pyridine. The reaction temperature varies depending on the structure of the dicarboxylic acid and diol to be used, but is preferably from 80° C. to 150° C.

The electrophotographic photoreceptor of the invention, comprising at least one layer containing a polymeric compound having a repeating unit represented by general formula (III) has high wear resistance and high heat resistance, and also exhibits low torque to a cleaning blade.

The polymeric compound having a repeating unit represented by general formula (III) has markedly rigid structures as shown in general formulas (IV) to (XI). Therefore, an electrophotographic photoreceptor comprising a layer containing the polymeric compound having a repeating unit represented by general formula (III) exhibits high heat resistance and high wear resistance.

Furthermore, the polymeric compound having a repeating unit represented by general formula (III) has good compatibility with functional materials such as charge transport material and charge generation material, each having some aromatic rings, and the surface of a charge transport layer containing the polymeric compound having a repeating unit represented by general formula (III) and a charge transport material, or the surface of a charge generation layer containing the polymeric compound having a repeating unit represented by general formula (III) and a charge generation material is a surface with less defects. Therefore, in case the charge transport layer or charge generation layer is a surface layer of the electrophotographic photoreceptor of the invention, the electrophotographic photoreceptor exhibits low torque to a cleaning blade.

The polymeric compound having a repeating unit represented by general formula (III) has high solubility in an organic solvent and low solution viscosity because it has rigid segment and also has an alkylene group as a soft segment, and thus making it possible to produce a coating solution having a high solid content. Consequently, the amount of an organic solvent can be reduced in the production process of the electrophotographic photoreceptor.

In the invention, X in general formula (III) is preferably a phenylene group, a naphthylene group, a butylene group or a hexylene group, more preferably a 1,4-phenylene group, a 1,3-phenylene group, a 2,6-naphthylene group, a 2,3-naphthylene group, an n-butylene group or an n-hexylene group, and particularly preferably a 1,4-phenylene group or a 2,6-naphthylene group.

In the invention, $R_{1a}$ and $R_{1b}$ in general formula (III) are, each independently, a methylene group, an ethylene group, an n-propylene group, an iso-propylene group, an n-butylene group, an iso-butylene group, an n-pentene group or an n-hexylene group, more preferably an ethylene group or an n-butylene group, and particularly preferably an ethylene group.

In the invention, Y in general formula (III) is preferably general formula (V), (VI), (VII) or (IX), more preferably general formula (V) or (VII), and particularly preferably general formula (V).

In the invention, n in general formula (III) is preferably from 10 to 100000, more preferably from 20 to 10000, and particularly preferably from 50 to 1000.

Specific examples of the polymeric compound having a repeating unit represented by general formula (III) of the present invention will be described below, but the invention is not limited by the following specific examples.

TABLE 8

| No. | Structual Formula |
|---|---|
| III-1 | 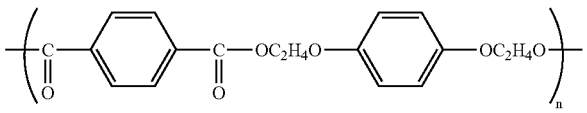 |
| III-2 | 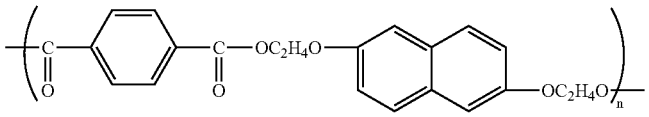 |

TABLE 8-continued
| No. | Structual Formula |
|---|---|
| III-3 | 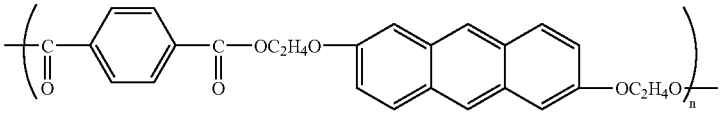 |
| III-4 | 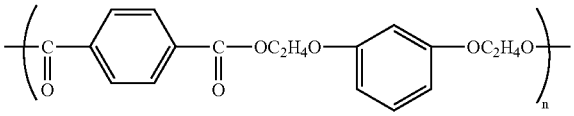 |
| III-5 | 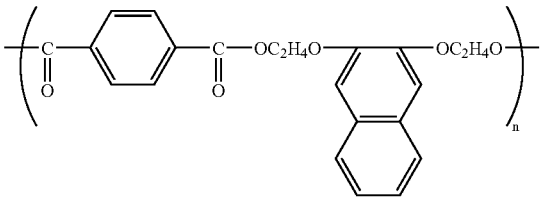 |
| III-6 | 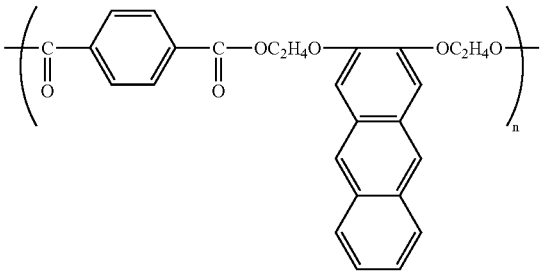 |
| III-7 | 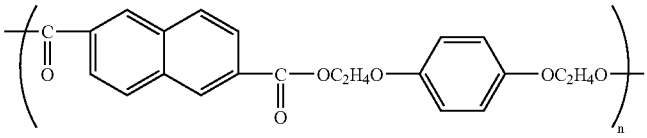 |
| III-8 | 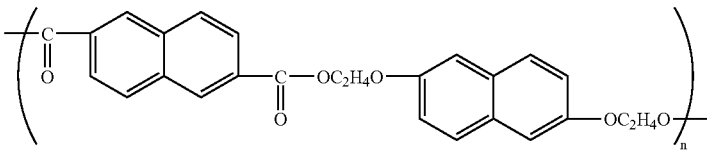 |
| III-9 | 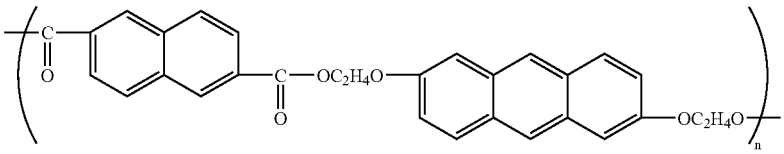 |

TABLE 9

| No. | Structual Formula |
|---|---|
| III-10 | 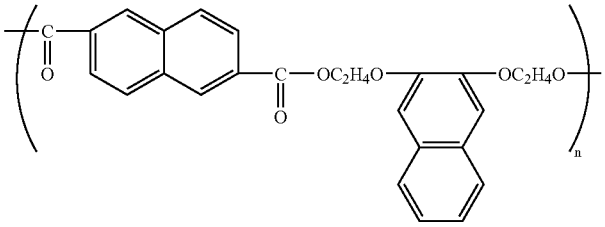 |
| III-11 | 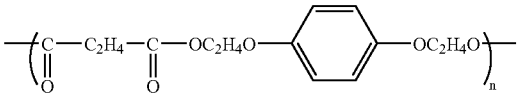 |
| III-12 | 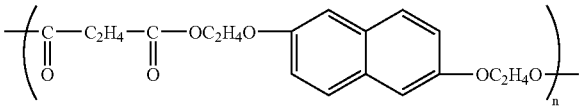 |
| III-13 | 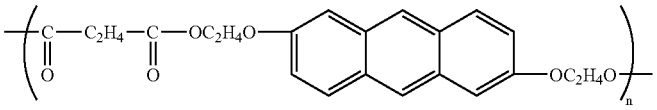 |
| III-14 | 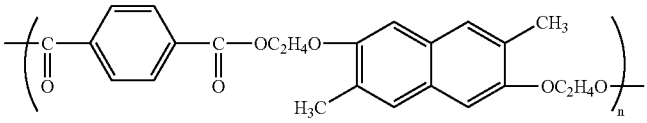 |
| III-15 | 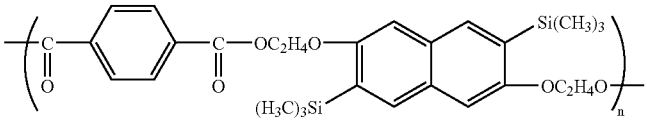 |
| III-16 | 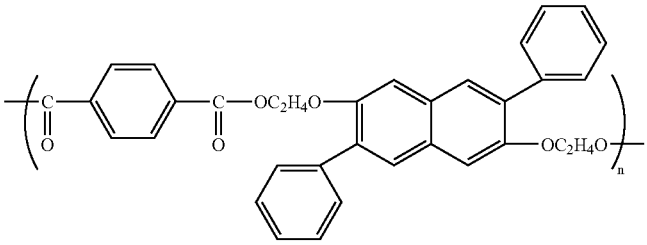 |

The method of producing the polymeric compound having a repeating unit represented by general formula (III) is not specifically limited, and known polymerization methods, for example, transesterification method, melt polycondensation method such as direct method, interfacial polymerization method and solution polymerization method can be used. It is preferable to be prepared by a process for melt polycondensation or solid phase polymerization of at least a dicarboxylic acid derivative represented by the following general formula (XVI) and a diol represented by the following general formula (XVII) because there is less necessity for improving the process to reduce environmental burden.

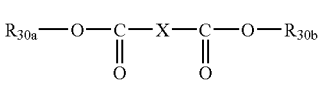

(XVI)

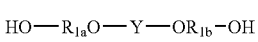

(XVII)

In general formula (XVI), $R_{30a}$ and $R_{30b}$ each independently represent a hydrogen atom, an alkyl group having 1 to 6 carbon atoms, or aryl group; and X is as defined in general formula (III). In general formula (XVII), $R_{1a}$, $R_{1b}$ and Y are as defined in general formula (III).

Either of the melt polycondensation and solid phase polymerization methods is a polymerization method, which causes less environmental burden because an organic solvent is not used.

The melt polycondensation method is composed of two steps, for example, a transesterification step and a polymerization reaction step, while a conventionally known technique used in the polymerization of polyester can be used with regard to catalyst and reaction conditions. Specific examples of the transesterification catalyst include acetates such as calcium acetate, zinc acetate, and manganese acetate; oxides such as zinc oxide; and titanic acids such as tetrabutoxytitanic acid. Examples of the polymerization catalyst include oxides such as germanium oxide, antimony trioxide, and tin dioxide; and titanic acids such as tetrabutoxytitanic acid.

Also in the solid phase polymerization method, a polymerization catalyst for melt polycondensation can be used.

The synthesized polymeric compound having a repeating unit selected from repeating units represented by general formulas (I) to (III) is sufficiently washed with dilute hydrochloric acid, distilled water, deionized water, ultrafiltered water and ultrapure water. Then, the synthesized polymeric compound is added dropwise in a poor solvent such as alcohol, there by to precipitate a polymeric compound, which is collected by filtration and then dried.

2 g of a finally obtained polymeric compound is dissolved in 20 ml of an organic solvent such as methylene chloride, toluene, monochlorobenzene or xylene, and then a water-soluble component is extracted from the solution using 80 ml of distilled water. The pH value of the resulting extract is preferably no greater than a value equal to the pH value of the distilled water+0.5, more preferably no greater than a value equal to the pH value of the distilled water+0.3, and particularly preferably no greater than a value equal to the pH value of the distilled water+0.2. If the pH value of the extract is no greater than a value equal to the pH value of the distilled water+0.5, a trap is unlikely to form, and a residual potential is unlikely to remain, such a pH value of the extract is therefore, preferable.

The electric conductivity of the extract is preferably 50 μS/cm or less, more preferably 30 μS/cm or less, and particularly preferably 20 μS/cm or less.

Since the electric conductivity of the extract is assigned to metal impurities in the polymeric compound, low electric conductivity means less metal impurities in the polymer compound. When the electric conductivity of the extract is 50 μS/cm or less, the amount of metal impurities in the extract decreases and electrical characteristics of the resulting electrophotographic photoreceptor are improved.

In the invention, a polymeric compound having a repeating unit selected from repeating units represented by general formulas (I) to (III) can be used in any functional layers of the electrophotographic photoreceptor, such as charge transport layer, charge generation layer, protective layer and undercoat layer without any limitation.

In the invention, at least one layer of layers containing a polymeric compound having a repeating unit selected from repeating units represented by general formulas (I) to (III) may be a charge transport layer.

In case the polymeric compound having a repeating unit selected from repeating units represented by general formulas (I) to (III) is used in a charge transport layer, the other polymeric compound can also be used in combination in the charge transport layer. Specific examples of the other polymeric compound include polycarbonate compound, polyester compound, polyimide compound, polyamide compound, polystyrene compound, polysiloxane compound, charge transferring polyester compound and charge transferring polycarbonate compound. Two or more kinds of these other polymeric compounds may be used in combination.

In the invention, a polymeric compound having a repeating unit selected from repeating units represented by general formulas (I) to (III) can be used in any functional layers of the electrophotographic photoreceptor, such as charge transport layer, charge generation layer, protective layer and undercoat layer without any limitation. At least one layer of layers containing a polymeric compound having a repeating unit selected from repeating units represented by general formulas (I) to (III) is preferably a surface layer because a maximum effect of wear resistance is exerted.

The surface layer as used herein refers to an outermost layer among various layers (functional layers) formed on a conductive substrate.

The surface layer containing a polymeric compound having a repeating unit selected from repeating units represented by general formulas (I) to (III) is more preferably a charge transport layer or a charge generation layer because torque of the electrophotographic photoreceptor of the invention to a cleaning blade can be reduced.

The charge transport layer in the electrophotographic photoreceptor of the invention will be described below.

The charge transport layer contains at least a charge transport material and a binder resin. The charge transport material is not specifically limited as far as it has a function of transferring charges. Specific examples thereof include hole transport materials such as pyrazoline derivative, aromatic tertiary diamino compound, aromatic tertiary amino compound, 1,2,4-triazine derivative, hydrazone derivative, quinazoline derivative, benzofuran derivative, α-stilbene derivative, enamine derivative, carbazole derivative, and poly-N-vinylcarbazole derivative; electron transport compounds such as quinone compound, tetracyanoxydimethane compound, fluorenone compound, oxadiazole compound, xanthone compound, thiophene compound, and diphenoquinone compound; and polymeric compounds including these structures. These materials may be used alone, or two or more kinds of them may be used in combination.

The charge transport layer preferably contains at least one kind of compound selected from the group consisting of compounds represented by the following general formulas (XVIII) to (XX) because of high mobility of charges.

(XVIII)

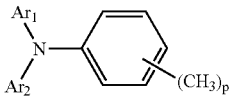

-continued (XIX)

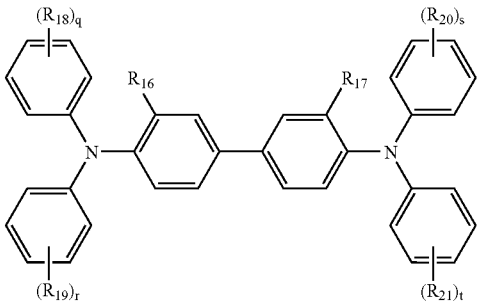

(XX)

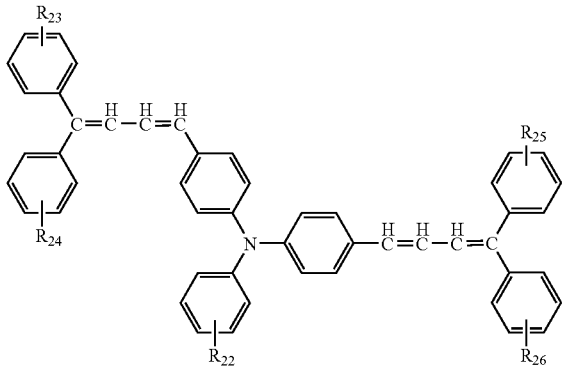

In general formula (XVIII), p represents an integer from 0 to 2, $Ar_1$ and $Ar_2$ each independently represent a substituted or unsubstituted aryl group. The substituent of the substituted aryl group represents an alkyl group having 1 to 5 carbon atoms, an alkoxy group having 1 to 5 carbon atoms, a substituted amino group substituted with at least one alkyl group having 1 to 3 carbon atoms, and a halogen atom.

In general formula (XIX), $R_{16}$ and $R_{17}$ each independently represent an alkyl group having 1 to 5 carbon atoms, an alkoxy group having 1 to 5 carbon atoms, or a halogen atom. $R_{18}$ to $R_{21}$ each independently represent an alkyl group having 1 to 5 carbon atoms, an alkoxy group having 1 to 5 carbon atoms, a substituted amino group substituted with at least one alkyl group having 1 to 2 carbon atoms, a substituted or unsubstituted aryl group, or a structure represented by the following general formula (XXI) or the following general formula (XXII). q to t each independently represent an integer from 0 to 2.

In general formula (XX), $R_{22}$ represents a hydrogen atom, an alkyl group having 1 to 5 carbon atoms, an alkoxy group having 1 to 5 carbon atoms, a substituted or unsubstituted aryl group, or a structure represented by the following general formula (XXI) or the following general formula (XXII). $R_{23}$ to $R_{26}$ each independently represent a hydrogen atom, an alkyl group having 1 to 5 carbon atoms, an alkoxyl group having 1 to 5 carbon atoms, a substituted amino group substituted with at least one alkyl group having 1 to 2 carbon atoms, or a substituted or unsubstituted aryl group.

(XXI)

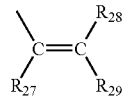

(XXII)

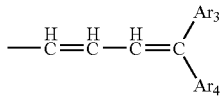

In general formula (XXI), $R_{27}$ to $R_{29}$ each independently represent a hydrogen atom, a substituted or unsubstituted alkyl group, or a substituted or unsubstituted aryl group. In general formula (XXII), $Ar_3$ and $Ar_4$ each independently represent a substituted or unsubstituted aryl group.

A binder resin used in the charge transport layer is not specifically limited. In case the charge transport layer is used as a surface layer, a polymeric compound having a repeating unit selected from repeating units represented by general formulas (I) to (III) is particularly preferable in view of wear resistance and low torque. Also in case a protective layer is formed on the charge transport layer, a polymeric compound having a repeating unit selected from repeating units represented by general formulas (I) to (III) is particularly preferable in view of high heat resistance.

It is also possible to use a binder resin other than the polymeric compound having a repeating unit selected from repeating units represented by general formulas (I) to (III). Specific examples thereof include polycarbonate compound, polyester compound, polyimide compound, polyamide compound, polystyrene compound, polysiloxane compound, charge transferring polyester compound and charge transferring polycarbonate compound.

These binder resins may be used alone, or two or more kinds of them may be used in combination.

A polymeric compound having a repeating unit selected from repeating units represented by general formulas (I) to (III) and compounds represented by general formulas (XVIII) to (XX) have a lot of aromatic rings and are excellent in compatibility because of a π—π stacking effect of them. As a result, the charge transport layer containing the polymeric compound having a repeating unit selected from repeating units represented by general formulas (I) to (III) and at least one compound selected from the group consisting of compounds represented by general formulas (XVIII) to (XX) is excellent in mechanical strength and electrical characteristics.

To the charge transport layer, various additives such as antioxidants and photostabilizers can be added, if necessary. Examples of the antioxidants include, but are not limited to, phenols, hindered amines and organosulfur antioxidants. Examples of the photostabilizer include, but are not limited to, benzophenones, benzotriazoles, dithiocarbamate and tetramethylpiperidine photostabilizers A coating solution for charge transport layer can be obtained by dissolving at least a polymeric compound having a repeating unit selected from repeating units represented by general formulas (I) to (III) and the charge transport material in an organic solvent.

The organic solvent to be used is not specifically limited and known organic solvents can be used. Specific examples thereof include alcohols such as methanol and ethanol; ketones such as acetone, methyl ethyl ketone, and cyclohexanone; esters such as ethyl acetate and n-butyl acetate; and toluene and tetrahydrofuran.

The electrophotographic photoreceptor of the invention preferably comprises a layer containing at least one of silicon-containing fine particles and fluorine-containing fine particles. The contaminant deposition resistance and lubricity of the surface of the electrophotographic photoreceptor are improved by providing the layer containing at least one of silicon-containing fine particles and fluorine-containing fine particles.

The layer containing at least one of silicon-containing fine particles and fluorine-containing fine particles is preferably a surface layer of the electrophotographic photoreceptor.

In this case, the surface layer preferably forms a charge transport layer. The contaminant deposition resistance and lubricity of the surface of the electrophotographic photoreceptor are improved by incorporating at least one of silicon-containing fine particles and fluorine-containing fine particles into the charge transport layer as the surface layer.

Furthermore, by incorporating at least one of silicon-containing fine particles and fluorine-containing fine particles into the charge transport layer, surface energy of the surface of the electrophotographic photoreceptor is lowered and lubricity is improved, and thus making it possible to reduce torque to a cleaning blade.

The silicon-containing fine particles refer to fine particles containing silicon as a constituent element and specific examples thereof include colloidal silica and silicone fine particles. Colloidal silica used as the silicon-containing fine particles is selected from colloidal silica having an average particle size of 1 to 100 nm, preferably 10 to 30 nm, dispersed in an acidic or alkali water dispersion, or an organic solvent such as alcohol, ketone or ester, and commercially available colloidal silica can be commonly used. The solid content of the colloidal silica in the surface layer or the charge transport layer of the electrophotographic photoreceptor according to the invention is not specifically limited, but is preferably within a range from 0.1 to 50% by weight, and more preferably from 0.1 to 30% by weight, based on the entire solid content in the surface layer or the charge transport layer in view of film-forming properties, electrical characteristics and strength.

The silicone fine particles used as the silicon-containing fine particles are spherical and are selected from silicone resin particles, silicone rubber particles and silicone surface-treated silica particles, each having an average particle size of 1 to 500 nm, preferably from 10 to 100 nm, and commercially available silicone fine particles can be commonly used. The silicone fine particles are particles having a small particle size which are chemically inherent and are excellent in dispersibility in the resin. Furthermore, the silicone fine particles can improve surface properties of the electrophotographic photoreceptor without adversely affecting the crosslinking reaction because the content required to achieve sufficient characteristics is small. That is, the silicone fine particles can improve the lubricity and water repellency of the surface of the electrophotographic photoreceptor in the state of being uniformly incorporated into the firm crosslinked structure, and thus making it possible to maintain satisfactory wear resistance and contaminant deposition resistance for a long period. The content of the silicone fine particles in the surface layer or the charge transport layer of the electrophotographic photoreceptor according to the invention is preferably within a range from 0.1 to 30% by weight, and more preferably from 0.5 to 10% by weight, based on the entire solid content in the surface layer or the charge transport layer.

The fluorine-containing fine particles refer to fine particles containing fluorine as a constituent element and specific examples thereof include fluorine fine particles made of ethylene tetrafluoride, ethylene trifluoride, propylene hexafluoride, vinyl fluoride, and vinylidene fluoride; and fine particles obtained by copolymerizing the fluororesin with a monomer having a hydroxyl group, disclosed in "Preliminary Manuscript of the eighth Lecture for Polymer Material Conference, page 89".

The content of the fluorine-containing fine particles in the surface layer or the charge transport layer of the electrophotographic photoreceptor according to the invention is preferably within a range from 0.1 to 30% by weight, more preferably from 0.5 to 20% by weight, and particularly preferably from 1 to 20% by weight, based on the entire solid content of the surface layer or the charge transport layer.

These silicon-containing fine particles and fluorine-containing fine particles may be used alone, or two or more kinds of them may be used in combination. Also other fine particles may be used in combination.

Specific examples of other fine particles include fine particles made of semiconductive metal oxides such as $ZnO—Al_2O_3$, $SnO_2—Sb_2O_3$, $In_2O_3—SnO_2$, $ZnO—TiO_2$, $MgO—Al_2O_3$, $FeO—TiO_2$, $TiO_2$, $SnO_2$, $In_2O_3$, ZnO and MgO.

For the same purposes, oil such as silicone oil can also be added to the surface layer or the charge transport layer. Examples of the silicone oil include silicone oils such as dimethylpolysiloxane, diphenylpolysiloxane, and phenylmethylsiloxane; reactive silicone oils such as amino-modified polysiloxane, epoxy-modified polysiloxane, carboxyl-modified polysiloxane, carbinol-modified polysiloxane, methacryl-modified polysiloxane, mercapto-modified polysiloxane, and phenol-modified polysiloxane.

Cyclic siloxanes include cyclic dimethylcyclosiloxanes such as hexamethylcyclotrisiloxane, octamethylcyclotetrasiloxane, decamethylcyclopentasiloxane, and dodecamethylcyclohexasiloxane; cyclic methylphenylcyclosiloxanes such as 1,3,5-trimethyl-1,3,5-triphenylcyclotrisiloxane, 1,3,5,7-tetramethyl-1,3,5,7-tetraphenylcyclotetrasiloxane, and 1,3,5,7,9-pentamethyl-1,3,5,7,9-pentaphenylcyclopentasiloxane; cyclic phenylcyclosiloxanes such as hexaphenylcyclotrisiloxane; fluorine-containing cyclosiloxanes such as 3-(3,3,3-trifluoropropyl)methylcyclotrisiloxane; hydrosilyl group-containing cyclosiloxanes such as methylhydrosiloxane mixture, pentamethylcyclopentasiloxane, and phenylhydrocyclosiloxane; and vinyl group-containing cyclosiloxanes such as pentavinylpentamethylcyclopentasiloxane.

The layer other than the surface layer or the charge transport layer may contain the silicon-containing fine particles, fluorine-containing fine particles and oil.

The electrophotographic photoreceptor of the invention may have a protective layer, if necessary. The protective layer may be made of a material containing a polymeric compound having a repeating unit selected from repeating units represented by general formulas (I) to (III), a material comprising a resin and conductive powder dispersed in the resin, or a hard coat agent such as silicone or acryl. In view of retention of the strength, electrical characteristics and image quality, a material containing a siloxane resin having charge transport properties and a crosslinked structure is preferable, and a siloxane resin having a structure represented by general formula (XXIII) is particularly preferable.

G—D—F (XXIII)

In general formula (XXIII), G represents an inorganic glassy network subgroup, D represents a flexible organic subunit, and F represents a charge transport subunit.

Examples of the charge transport subunit include triarylamine compound, benzidine compound, arylalkane compound, aryl-substituted ethylene compound, stilbene compound, anthracene compound, hydrazone compound, quinone compound, fluorenone compound, xanthone compound, benzophenone compound, cyanovinyl compound and ethylene compound. Among these compounds, a triarylamine compound is preferable in view of combination with the charge transport layer of the electrophotographic photoreceptor of the invention.

The inorganic glassy network subgroup includes, for example, a structure having a reactive Si group. These network subgroups cause the crosslinking reaction with each other to form a three-dimensional Si—O—Si bond.

The flexible organic subunit imparts proper flexibility to a hard and brittle inorganic glassy network. Specific examples thereof include alkylene straight chain and unsaturated hydrocarbon group.

The charge generation layer in the electrophotographic photoreceptor of the invention will be described below. The charge generation layer contains a charge generation material and a binder resin.

The charge generation material is not specifically limited as far as it has a charge generation function, and known charge generation materials can be used. Specific examples thereof include azo pigments such as bisazo and trisazo pigments; condensed ring aromatic pigments such as dibromoanthanthron pigment; and perylene pigment, pyrrolopyrrole pigment, phthalocyanine pigment and selenium.

Among these pigments, phthalocyanine pigments such as titanyl phthalocyanines, gallium phthalocyanines and halogenated tinphthalocyanine pigments, which can realize high sensitivity, are preferable in view of combination with the charge transport layer of the electrophotographic photoreceptor according to the invention, and a hydroxygallium phthalocyanine pigment is particularly preferable.

The binder resin used in the charge generation layer is not specifically limited. Specific examples thereof include polymeric compound having a repeating unit selected from repeating units represented by general formulas (I) to (III), polyvinylbutyral resin, polyallylate resin, polyester resin, polycarbonate resin, phenoxy resin, polyamide resin, acrylic resin, polyacrylamide resin, polyvinyl pyridine resin, cellulose resin, urethane resin, epoxy resin, casein, polyvinyl alcohol resin, polyvinyl pyrrolidone resin, polystyrene resin, vinyl chloride-vinyl acetate copolymer, and copolymers thereof.

Among these bindert resins, a polyvinyl butyral resin, a copolymer of polystyrene and an acrylic resin, and a polymeric compound having a repeating unit represented by general formula (III) are preferable in view of the dispersibility of the charge generation material. In case the charge generation layer is used as the surface layer, a polymeric compound having a repeating unit represented by general formula (II) is preferable in view of low torque.

The charge transport layer may double as the charge generation layer. When the charge transport layer doubles as the charge generation layer, the charge transport layer may be made of a material which is composed of a charge generation material, a charge transfer material, a binder material and, if necessary, additives such as antioxidants and lubricants, the binder material being a polymeric compound having a repeating unit selected from repeating units represented by general formulas (I) to (III).

The electrophotographic photoreceptor of the invention may have an undercoat layer. Examples of the compound used in the undercoat layer include organozirconium compounds such as zirconium chelate compound, zirconium alkoxide compound, and zirconium coupling agent; organotitanium compounds such as titanium chelate compound, titanium alkoxide compound, and titanate coupling agent; organoaluminum compounds such as aluminum chelate compound and aluminum coupling agent; and organometal compounds such as indium chelate compound, manganese alkoxide compound, manganese chelate compound, tin alkoxide compound, tin chelate compound, aluminum silicone alkoxide compound, and aluminum titanium alkoxide compound.

Also the undercoat layer can contain silane coupling agents such as vinyltrichlorosilane, vinyltrimethoxysilane, vinyltriethoxysilane, vinyltris-2-methoxyethoxysilane, vinyltriacetoxysilane, γ-glycidoxypropyltrimethoxysilane, γ-methacryloxypropyltrimethoxysilane, γ-aminopropyltriethoxysilane, γ-chloropropyltrimethoxysilane, γ-2-aminoethylaminopropyltrimethoxysilane, γ-mercaptopropyltrimethoxysilane, γ-ureidopropyltriethoxysilane and β-3,4-epoxycyclohexyltrimethoxysilane.

Furthermore, there can be used binder resins such as polyvinyl alcohol, polyvinyl methyl ether, poly-N-vinylimidazole, polyethylene oxide, ethylcellulose, methylcellulose, ethylene-acrylic acid copolymer, polyamide, polyimide, casein, gelatine, polyethylene, polyester, phenol resin, vinyl chloride-vinyl acetate copolymer, epoxy resin, polyvinyl pyrrolidone, polyvinyl pyridine, polyurethane, polyglutamic acid and polyacrylic acid, and a polymeric compound having a repeating unit selected from repeating units represented by general formulas (I) to (III) can also be used. A mixing ratio can be appropriately set, if necessary.

Also electron transport pigments can be dispersed in the undercoat layer. Examples of the electron transport pigment include organic pigments such as perylene pigment, bisbenzimidazoleperylene pigment, polycyclic quinone pigment, indigo pigment, and quinacridone pigment; bisazo pigments having an electron attractive substituent such as cyano group, nitro group or nitroso group; organic pigments such as phthalocyanine pigment; and zinc oxide and titanium oxide.

The electrophotographic photoreceptor of the invention preferably has an undercoat layer containing at least one of zinc oxide and titanium oxide, which have particularly high electron mobility.

For the purpose of controlling dispersibility and electron transport properties, the surface of these pigments may be treated with the above coupling agents. A mixing ratio of the electron transport pigment in the undercoat layer is preferably not less than 5% by weight and not more than 95% by weight, and more preferably not less than 10% by weight and not more than 90% by weight. When the mixing ratio is not less than 5% by weight, sufficient electron transport effect can be ensured. On the other hand, when the mixing ratio is not more than 95% by weight, sufficient mechanical strength of the undercoat layer can be ensured and coating film defects are less likely to occur.

A coating solution for undercoat layer can be dispersed by a known method using a ball mill, a roll mill, a sand mill, an attritor or ultrasonic wave. A dispersion solvent is not specifically limited and there can be used known dispersion solvents, for example, alcohols such as methanol and ethanol; ketones such as acetone and methyl ethyl ketone; esters such as ethyl acetate and n-butyl acetate; and toluene and tetrahydrofuran.

The method of producing an electrophotographic photoreceptor of the invention will be described below. The electrophotographic photoreceptor of the invention can be obtained by applying coating solutions for each functional layer on a conductive substrate to form the respective layers in order. As the conductive substrate, there can be used metal such as aluminum, or conductive resin formed into a drum, sheet or plate. For the purpose of prevention of injection, security of adhesion and prevention of interference fringe, the surface of the conductive substrate can be treated by a honing treatment, a boehmite treatment or anodization. The coating solutions for each functional layer can be applied by a known method such as dip coating, spray coating or die coating method.

The layer configuration of the electrophotographic photoreceptor of the invention includes, for example, undercoat layer/charge generation layer/charge transport layer (surface layer) each being laminated on a conductive substrate in this order, undercoat layer/charge generation layer/charge transport layer/protective layer (surface layer) each being laminated on a conductive substrate in this order, undercoat layer/charge transport layer/charge generation layer/protective layer (surface layer) each being laminated on a conductive substrate in this order, undercoat layer/charge transport layer (doubles as a surface layer and a charge generation layer) each being laminated on a conductive substrate in this order, undercoat layer/charge transport layer (doubles as a charge generation layer)/protective layer (surface layer) each being laminated on a conductive substrate in this order, or layer configurations with no undercoat layer.

<Electrophotographic Process Cartridge>

The electrophotographic process cartridge of the invention comprises at least the electrophotographic photoreceptor of the invention.

FIG. 1 is a schematic view showing an example of the electrophotographic process cartridge of the invention. An electrophotographic process cartridge 10 shown in FIG. 1 comprises an electrophotographic photoreceptor 1, and a charging device 2, a developing device 3, a transferring device 4 and a cleaning device 5 arranged around the electrophotographic photoreceptor 1, and the electrophotographic photoreceptor of the invention is used as the electrophotographic photoreceptor 1.

As the charging device 2, for example, a charging roll, corotron or scorotron is used. As the cleaning device 5, for example, a cleaning blade or a cleaning brush is used.

The electrophotographic process cartridge of the invention is removable from an image forming apparatus in the form of an integral structure. Since the electrophotographic photoreceptor of the invention is used in the electrophotographic process cartridge of the invention, the surface layer has high mechanical strength and the wear resistance is excellent, and also the electrophotographic photoreceptor has long lifetime. Furthermore, it is possible to use the machine until failure without replacing the electrophotographic photoreceptor, and to replace or recycle as the process cartridge without disassembling the respective parts.

<Image Forming Apparatus>

The image forming apparatus of the invention comprises an electrophotographic photoreceptor, charging means for uniformly charging the electrophotographic photoreceptor, latent image forming means for forming a latent image on a surface of the charged electrophotographic photoreceptor, developing means for developing the latent image formed on the surface of the electrophotographic photoreceptor with a developer containing at least a toner to form a toner image, transferring means for transferring the toner image formed on the surface of the electrophotographic photoreceptor onto a toner image receiving body, and cleaning means for removing residual toner on the surface of the electrophotographic photoreceptor after the toner image has been transferred and the electrophotographic photoreceptor is that of the present invention.

Figure 2:
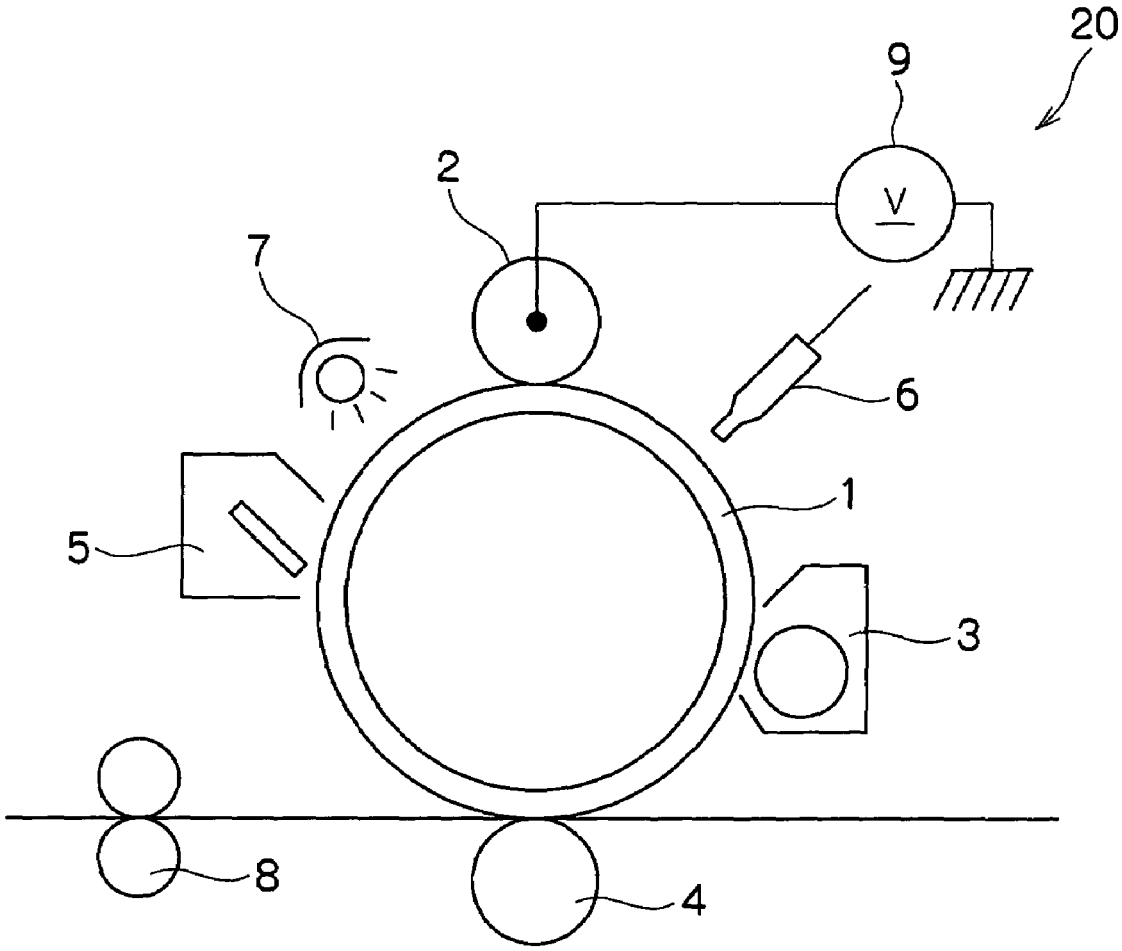
FIG. 2 is a schematic view showing an example of an image forming apparatus of the invention.

FIG. 2 is a schematic view showing an example of an image forming apparatus of the invention.

An image forming apparatus 20 shown in FIG. 2 comprises an electrophotographic photoreceptor 1, a charging device 2 for uniformly charging the electrophotographic photoreceptor 1, a power supply 9 connected to the charging device 2, an exposing device 6 for exposing the electrophotographic photoreceptor 1 charged by the charging device 2 to light to form an electrostatic latent image, a developing device 3 for developing the electrostatic latent image formed by the exposing device 6 with a toner to form a toner image, a transferring device 4 for transferring the toner image formed by the developing device 3 onto a material to be transferred, a cleaning device 5, a deelectrification device 7 and a fixing device 8.

The charging device 2, the developing device 3, the transferring device 4, the cleaning device 5, the deelectrification device 7 and fixing device 8 used in the image forming apparatus 20 may be conventionally known devices. The electrophotographic photoreceptor 1, the charging device 2, the developing device 3, the transferring device 4 and the cleaning device 5 may be optionally integrated to form an electrophotographic process cartridge.

Although the image forming apparatus 20 comprises one electrophotographic photoreceptor, an image forming apparatus of an intermediate transfer system is also included in the scope of the invention.

That is, a so-called tandem type image forming apparatus wherein four electrophotographic photosensitive bodies are mutually arranged in parallel along an intermediate transfer belt is used as a preferable aspect of the image forming apparatus of the invention.

Since the image forming apparatus of the invention is provided with the electrophotographic photoreceptor of the invention, image with high image quality can be formed.

The toner used in the image forming apparatus of the invention is preferably a spherical toner, and more preferably a toner having an average spherical index of 100 to 140.

The use of the spherical toner makes it possible to obtain an image with high developability, high transferrability and high image quality.

As used herein, the average spherical index refers to a value obtained by calculating $(ML^2/A\times(\pi/4)\times100)$ from a maximum length (ML) and a projected area (A) of the toner and averaging the resulting calculated values.

As the method of producing the spherical toner, for example, there can be used a method of changing the shape of particles obtained by a kneading and pulverization method of kneading a binder resin, a colorant, a releasant and, if necessary, a charge control agent and pulverizing the kneaded mixture, followed by screening, by means of a mechanical impact force or thermal energy; an emulsion aggregation method of mixing a dispersion prepared by emulsion polymerization of a polymerizable monomer of a binder resin, and a suspension of a colorant, a releasant and, if necessary, a charge control agent to form an aggregate, and melting the aggregate with heating to obtain toner particles; a suspension polymerization method of suspending a polymerizable monomer for obtaining a binder resin, and a solution of a colorant, a releasant and, if necessary, a charge control agent in an aqueous solvent, and polymerizing the suspension; and a solution suspension method of suspending a binder resin, and a solution of a colorant, a releasant and, if necessary, a charge control agent in an aqueous solvent to form particles.

Among these methods, a suspension polymerization method an emulsion aggregation method and a solution suspension method, each using an aqueous solvent, are preferable and an emulsion aggregation method is particularly preferable in view of control of the shape and particle size distribution.

It is also possible to use a toner having a core-shell structure produced by using the toner obtained by the above method as a core, depositing aggregated particles thereon, followed by fusing with heating.

The spherical toner contains a binder resin, a colorant and a releasant and, if necessary, silica as a dispersing auxiliary, and a charge control agent.

An average particle size of the toner is preferably from 2 to 12 μm, and more preferably from 3 to 9 μm. When the average particle size is not less than 2 μm, it is easy to clean the residual toner on the surface of the electrophotographic photoreceptor, and thus poor image quality is less likely to be caused by poor cleaning. When the average particle size is not more than 12 μm, resolution of the image can be improved.

Examples of the binder resin used in the toner include homopolymers and copolymers of, for example, styrenes such as styrene and chlorostyrene; monoolefins such as ethylene, propylene, butylene, and isoprene; vinyl esters such as vinyl acetate, vinyl propionate, vinyl benzoate, and vinyl butyrate; aliphatic α-methylenemonocarboxylic acid esters such as methyl acrylate, ethyl acrylate, butyl acrylate, dodecyl acrylate, and dodecyl methacrylate; ethyl ethers such as vinyl methyl ether, vinyl ethyl ether, and vinyl butyl ether; and vinyl ketones such as vinyl methyl ketone, vinyl hexyl ketone, and vinyl isopropenyl ketone. Typical examples thereof include polystyrene, styrene-alkyl acrylate copolymer, styrene-alkyl methacrylate copolymer, styrene-acrylonitrile copolymer, styrene-butadiene copolymer, styrene-maleic anhydride copolymer, polyethylene, and polypropylene; and polyester, polyurethane, epoxy resin, silicone resin, polyamide, modified resin, and paraffin wax.

Specific examples of the colorant in the toner include magnetic powders made of magnetite and ferrite, Carbon Black, Aniline Blue, Chrome Yellow, Ultramarine Blue, Du Pont Oil Red, Quinoline Yellow, Methylene Blue Cloride, Phthalocyanine Blue, Malachite Green Oxalate, Lamp Black, Rose Bengal C.I. Pigment Red 48:1, C.I. Pigment Red 122, C.I. Pigment Red 57:1, C.I. Pigment Yellow 97, C.I. Pigment Yellow 17, C.I. Pigment Blue 15:1, and C.I. Pigment Blue 15:3.

Specific examples of the releasant include low molecular weight polyethylene, low molecular weight polypropylene, Fischer-Tropsch wax, montan wax, carnauba wax, rice wax, and Candelilla wax.

Examples of the antistatic agent used in the toner include azo metal complex compound, metal complex compound of salicylic acid, and resin type one having a polar group.

The toner used in the invention may contain other additives such as lubricant particles and abrasive particles. Examples of the lubricant particles include particles made of graphite, molybdenum disulfide, talc, low molecular weight polyolefin, aliphatic amides, silicones and various vegetable waxes. Examples of the abrasive include inorganic particles made of cerium oxide, magnesium titanate and silicon nitride; and organic fine particles such as styrene resin fine particles and styrene acrylic resin fine particles.

The toner may be mixed with a carrier. As the carrier, iron powder, glass beads, ferrite powder, nickel powder, or carriers obtained by coating the surface thereof with a resin. A mixing ratio of the toner to the carrier can be appropriately set.

In the image forming apparatus of the invention, an exposure light source used in the latent image forming means is preferably laser light having a wavelength of 450 nm or shorter, and more preferably from 380 to 450 nm. When using laser light having a wavelength of 450 nm or shorter as an exposure light source, it is made possible to narrow down an exposure spot to about 30 nm, and thus an image with high image quality can be realized.

The electrophotographic photoreceptor of the invention can achieve high photoreceptor driving accuracy and can cope with the narrowed down exposure spot because of excellent wear resistance, excellent lubricity and low torque to cleaning means.

EXAMPLES

The present invention will be described in detail by way of examples, but the invention is not limited by the following examples.

Examples and Comparative Examples Using a Polymeric Compound Having a Repeating Unit Represented by General Formula (I)

Example 1A

100 Parts by weight of zinc oxide (manufactured by TAYCA CORPORATION, SMZ-017N) and 500 parts by weight of toluene are mixed with stirring and 2 parts by weight of a silane coupling agent (manufactured by Nippon Unicar Co., Ltd., A1100) is added, followed by stirring for 5 hours. After toluene is distilled off under reduced pressure, the mixture is baked at 120° C. for 2 hours to obtain surface-treated zinc oxide.

35 Parts by weight of the surface-treated zinc oxide, 15 parts by weight of blocked isocyanate (manufactured by Sumitomo Bayer Urethane Co., Ltd., SUMIJULE 3175) as a curing agent, 6 parts by weight of a butyral resin (manufactured by SEKISUI CHEMICAL CO., LTD., BM-1) and 44 parts by weight of methyl ethyl ketone are mixed and dispersed in a sand mill using 1 mmϕ glass beads for 2 hours to obtain a dispersion.

To the resulting dispersion, 0.005 parts by weight of dioctyltin dilaurate as a catalyst and 17 parts by weight of a silicone resin (manufactured by GE Toshiba Silicones Co., Ltd., TOSPEARL 130) are added to obtain a coating solution for undercoat layer. The resulting coating solution is applied on a 84 mm drawn tube substrate made of a JIS H4080 A3003 alloy by a dip coating method and cured with drying at 160° C. for 100 minutes to obtain a 20 μm thick undercoat layer.

1 Part by weight of chlorogalliumphthalocyanine having strong diffraction peaks at Bragg angles (2θ±0.2°) of 7.4°, 16.6°, 25.5° and 28.3° in an X-ray diffraction spectrum, 1 part by weight of a polybutyral resin (manufactured by SEKISUI CHEMICAL CO., LTD., BM-S) and 100 parts by weight of butyl acetate are mixed and dispersed, together with glass beads, using a paint shaker for one hour to obtain a coating solution. The resulting coating solution is dip-coated on the undercoat layer and then dried with heating at 100° C. for 10 minutes to form an about 0.15 μm thick charge generation layer.

Then, a coating solution for charge transport layer prepared by dissolving 3 parts by weight of a polymeric compound (weight average molecular weight: 38000) having a basic structure shown in Table 10 and 2 parts by weight of a benzidine compound shown in Table 10 in 20 parts by weight of tetrahydrofuran is dip-coated on the charge generation layer to obtain a charge transport layer, and thus an electrophotographic photoreceptor is obtained.

The resulting electrophotographic photoreceptor is mounted to a process cartridge for printer (manufactured by Fuji Xerox Co., Ltd., DOCUCENTER COLOR 500) and a wear rate of the photoreceptor after printing 10000 sheets is measured by an eddy current thickness sensor, and also a thermal bending temperature is measured according to HDT 0.45 MPa (ISO 75-2). Furthermore, the absence or presence of solvent cracks is visually evaluated. Also the absence or presence of deposition of the toner onto the electrophotographic photoreceptor is visually evaluated, and the absence or presence of image quality defects is visually evaluated. As used herein, the wear rate refers to an amount of wear of the electrophotographic photoreceptor for every 1000 sheets printed.

Torque between an electrophotographic photoreceptor and a cleaning blade is evaluated by HEIDON (manufactured by Shinto kagaku Co., Ltd. TRIBOGEAR TYPE 941). The results are shown in Table 14.

An exposure light source (manufactured by Fuji Xerox Co., Ltd., DOCUCENTER COLOR 500) has a wavelength of 780 nm.

Examples 2A to 6A

In the same manner as in Example 1A, except that the polymeric compound used in the charge transport layer is replaced by polymeric compounds for Examples 2A to 6A shown in Table 10 and Table 11, electrophotographic photosensitive bodies are obtained and evaluated in the same manner as in Example 1A. The results are shown in Table 14.

Each weight average molecular weight of the polymeric compounds used in Example 2A to 6A is as follows: Example 2A: 35000, Example 3A: 60000, Example 4A: 40000, Example 5A: 35000, and Example 6A: 50000.

TABLE 10
| Partition | Polymeric Compound (Binder Resin) | Charge Transport Material |
|---|---|---|
| Example 1A | 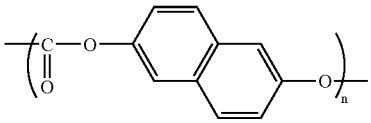 | 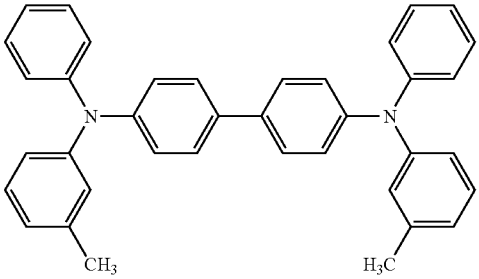 |
| Example 2A | 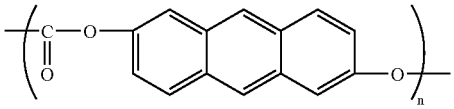 | The same as Example 1A |
| Example 3A | 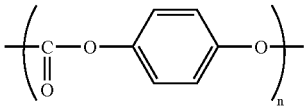 | The same as Example 1A |
| Example 4A | 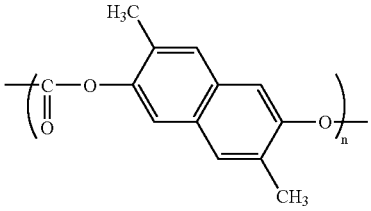 | The same as Example 1A |

TABLE 11

| Partition | Polymeric Compound (Binder Resin) | Charge Transport Material |
|---|---|---|
| Example 5A | 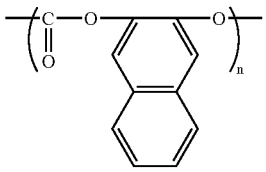 | The same as Example 1A |
| Example 6A | 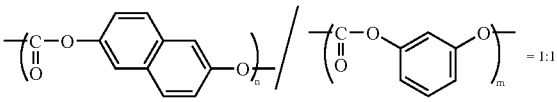 | The same as Example 1A |
| Example 7A | The same as Example 1A | 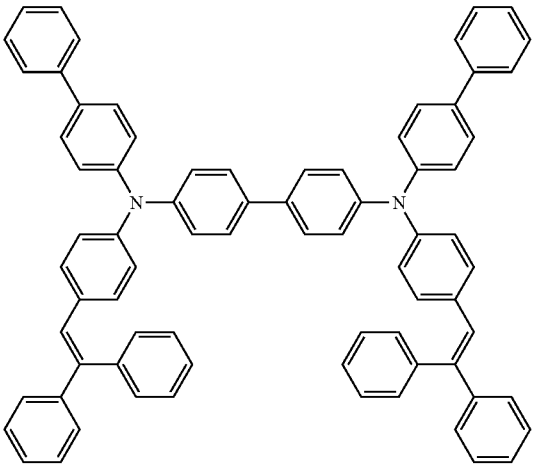 |

Example 7A

In the same manner as in Example 1A, except that the charge transport material used in the charge transport layer is replaced by a compound for Example 7A shown in Table 11, an electrophotographic photoreceptor is obtained and evaluated in the same manner as in Example 1A. The results are shown in Table 14.

Example 8A

In the same manner as in Example 1A, except that 6 parts by weight of hydroxygallium phthalocyanine having strong diffraction peaks at Bragg angles (2θ±0.2°) of 7.5°, 9.9°, 12.5°, 16.3°, 18.6°, 25.1° and 28.3° in an X-ray diffraction spectrum is mixed with 4 parts by weight of a vinyl chloride-vinyl acetate copolymer (manufactured by Nippon Unicar Co., Ltd., VMCH) and 40 parts by weight of butyl acetate and the mixture is dispersed, together with glass beads, using a paint shaker for one hour to obtain a coating solution, and the resulting coating solution is dip-coated on the undercoat layer and then dried with heating at 130° C. for 10 minutes to form an about 0.15 μm thick charge generation layer, an electrophotographic photoreceptor is obtained and evaluated in the same manner as in Example 1A. The results are shown in Table 14.

Example 9A

In the same manner as in Example 1A, except that 0.5 parts by weight of silicone resin fine particles (manufactured by GE Toshiba Silicones Co., Ltd., TOSPEARL 105) is added to a coating solution for charge transport layer and then dispersed, together with glass beads, using a paint shaker for one hour, an electrophotographic photoreceptor is obtained and evaluated in the same manner as in Example 1A. The results are shown in Table 14.

Example 10A

2 Parts by weight of the compound shown in Table 12, 2 parts by weight of methyltrimethoxysilane, 0.5 parts by weight of tetramethoxysilane and 0.3 parts by weight of colloidal silica are dissolved in 5 parts by weight of isopropyl alcohol, 3 parts by weight of tetrahydrofuran and 0.3 parts by weight of distilled water and 0.5 parts by weight of an ion exchange resin (AMBERLIST 15E manufactured by Rhom & Haas Co.) is added, and then the mixture is hydrolyzed for 24 hours by stirring at room temperature.

TABLE 12

| Partition | Compound |
|---|---|
| Example 10A | 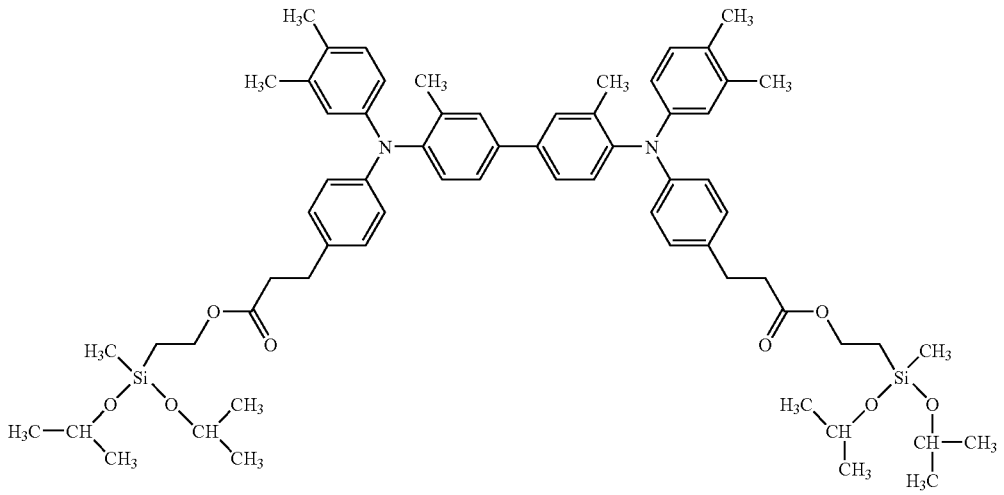 |

To a solution prepared by removing the ion exchange resin from the hydrolyzed product due to filtration, 0.1 parts by weight of aluminum trisacetylacetonate (Al (aqaq)$_3$), 0.4 parts by weight of 3,5-di-t-butyl-4-hydroxytoluene (BHT) and 0.02 parts by weight of polytetrafluoroethylene particles (manufactured by DAIKIN INDUSTRIES, LTD., RUBLON L-2) are added. The resulting coating solution is applied on the surface of the electrophotographic photoreceptor obtained in Example 1A by a ring type dip coating method, dried at room temperature for 30 minutes and then cured with heating at 170° C. for one hour to form an about 3 μm thick protective layer, and thus an electrophotographic photoreceptor is obtained. The resulting electrophotographic photoreceptor is evaluated in the same manner as in Example 1A. The results are shown in Table 14.

Example 11A

Each 2 parts by weight of two kinds of compounds A and B shown in Table 13 and 0.05 parts by weight of tetramethoxysilane are dissolved in 5 parts by weight of isopropyl alcohol, 3 parts by weight of tetrahydrofuran and 0.3 parts by weight of distilled water and 0.05 parts by weight of an ion exchange resin (AMBERLIST 15E manufactured by Rhom & Haas Co.) is added, and then the mixture is hydrolyzed for 24 hours by stirring at room temperature.

TABLE 13

| Partition | Compound A | Compound B |
|---|---|---|
| Example 11A | 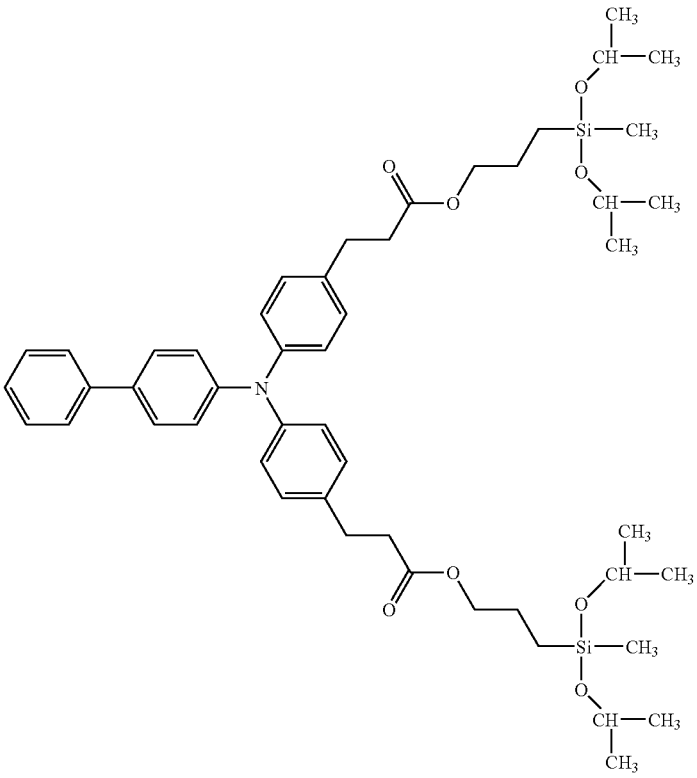 | 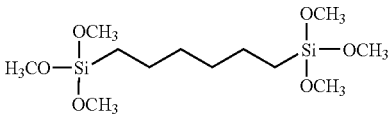 |

The ion exchange resin is removed from the solution by filtration thus obtained by filtrate. To 2 parts by weight of the resulting filtrate, 0.04 parts by weight of aluminum trisacetylacetonate and 0.02 parts by weight of 3,5-di-tert-butyl-4-hydroxytoluene are added to obtain a coating solution. The resulting coating solution is applied on the surface of the electrophotographic photoreceptor obtained in Example 1A by a ring type dip coating method, dried at room temperature for 30 minutes, and then cured with heating at 170° C. for one hour to form an about 3 μm thick protective layer, and thus an electrophotographic photoreceptor is obtained. The resulting electrophotographic photoreceptor is evaluated in the same manner as in Example 1A. The results are shown in Table 14.

Example 12A

With regard to the electrophotographic photoreceptor obtained in Example 1A, in the same manner as in Example 1A, except that, the exposure light source of the printer (manufactured by Fuji Xerox Co., Ltd., DOCUCENTER COLOR 500) is replaced by laser having a wavelength of 405 nm, the evaluation is conducted. The results are shown in Table 14.

Comparative Example 1A

In the same manner as in Example 1A, except that bisphenol Z type polycarbonate (manufactured by MITSUBISHI CHEMICAL CORPORATION, YUPILON Z400) is used as the polymeric compound of the charge transport layer, an electrophotographic photoreceptor is obtained and evaluated in the same manner as in Example 1A. The results are shown in Table 14.

Comparative Example 2A

In the same manner as in Example 1A, except that bisphenol A type polycarbonate (manufactured by TEIJIN LIMITED, PANLITE) is used as the polymeric compound of the charge transport layer, an electrophotographic photoreceptor is obtained and evaluated in the same manner as in Example 1A. The results are shown in Table 14.

Comparative Example 3A

In the same manner as in Example 1A, except that bisphenol A type polyallylate (manufactured by UNITIKA LTD., U POLYMER) is used as the polymeric compound of the charge transport layer, an electrophotographic photoreceptor is obtained and evaluated in the same manner as in Example 1A. The results are shown in Table 14.

TABLE 14

| Partition | Wear Rate (nm/Kcyc) | Thermal Bending Temperature (° C.) | Solvent Crack | Torque | Deposition | Image Defects |
|---|---|---|---|---|---|---|
| Example 1A | 12 | 80 | None | 5.5 | None | None |
| Example 2A | 10 | 85 | None | 5.2 | None | None |
| Example 3A | 14 | 74 | None | 5.5 | None | None |
| Example 4A | 16 | 72 | None | 5.8 | None | None |
| Example 5A | 15 | 76 | None | 5.4 | None | None |
| Example 6A | 16 | 75 | None | 5.7 | None | None |
| Example 7A | 13 | 80 | None | 5.6 | None | None |
| Example 8A | 11 | 79 | None | 4.0 | None | None |
| Example 9A | 12 | 80 | None | 5.5 | None | None |
| Example 10A | 3 | 120 | None | 5.8 | None | None |
| Example 11A | 1 | 130 | None | 6.0 | None | None |
| Example 12A | 12 | 80 | None | 5.5 | None | None |
| Comparative Example 1A | 45 | 56 | None | 7.5 | Occurred | Streak-Like Defects |
| Comparative Example 2A | 50 | 55 | Occurred | 8.0 | Occurred | Streak-Like Defects |
| Comparative Example 3A | 35 | 62 | Occurred | 8.0 | Occurred | Streak-Like Defects |

As is apparent from Table 14, the electrophotographic photosensitive bodies comprising at least one layer containing the polymeric compound having a repeating unit represented by general formula (I) of the invention have high mechanical strength and high heat resistance, and therefore have markedly high wear resistance, and also cause no solvent cracks which may occur in case of high mechanical strength. Since low torque to a cleaning blade enables strong cleaning, deposition of the toner, as a feature of the electrophotographic photoreceptor having high wear resistance, is not observed and thus image quality of the image forming apparatus of the invention is excellent.

On the other hand, the electrophotographic photosensitive bodies shown in Comparative Example 1A to 3A, which are not within the scope of the invention, have poor wear resistance because of low mechanical strength and poor heat resistance. Particularly in case of the electrophotographic photosensitive bodies of Comparative Example 2A and 3A, solvent cracks occurred. These electrophotographic photosensitive bodies are not capable of strong cleaning because of high torque to a cleaning blade, and thus the toner is deposited to cause image defects.

Examples and Comparative Examples Using a Polymeric Compound Having a Repeating Unit Represented by General Formula (II)

Example 1B

100 Parts by weight of zinc oxide (manufactured by TAYCA CORPORATION, SMZ-017N) and 500 parts by weight of toluene are mixed with stirring and 2 parts by weight of a silane coupling agent (manufactured by Nippon Unicar Co., Ltd., A1100) is added, followed by stirring for 5 hours. After toluene is distilled off under reduced pressure, the mixture is baked at 120° C. for 2 hours to obtain surface-treated zinc oxide.

35 Parts by weight of the surface-treated zinc oxide, 15 parts by weight of blocked isocyanate (manufactured by Sumitomo Bayer Urethane Co., Ltd., SUMLTULE 3175) as a curing agent, 6 parts by weight of a butyral resin (manufactured by SEKISUI CHEMICAL CO., LTD., BM-1) and 44 parts by weight of methyl ethyl ketone are mixed and dispersed in a sand mill using 1 mmϕ glass beads for 2 hours to obtain a dispersion.

To the resulting dispersion, 0.005 parts by weight of dioctyltin dilaurate as a catalyst and 17 parts by weight of a silicone resin (manufactured by GE Toshiba Silicones Co., Ltd., TOSPEARL 130) are added to obtain a coating solution for undercoat layer. The resulting coating solution is applied on a 84 mm drawn tube substrate made of a JIS H4080 A3003 alloy by a dip coating method and cured with drying at 160° C. for 100 minutes to obtain a 20 μm thick undercoat layer.

1 Part by weight of chlorogalliumphthalocyanine having strong diffraction peaks at Bragg angles (2θ±0.2°) of 7.4°, 16.6°, 25.5° and 28.3° in an X-ray diffraction spectrum, 1 part by weight of a polybutyral resin (manufactured by SEKISUI CHEMICAL CO., LTD., BM-S) and 100 parts by weight of butyl acetate are mixed and dispersed, together with glass beads, using a paint shaker for one hour to obtain a coating solution. The resulting coating solution is dip-coated on the undercoat layer and then dried with heating at 100° C. for 10 minutes to form an about 0.15 μm thick charge generation layer.

Then, a coating solution for change transport layer prepared by dissolving 3 parts by weight of a polymeric compound (weight average molecular weight: 40000) having a basic structure shown in Table 15 and 2 parts by weight of a benzidine compound shown in Table 15 in 20 parts by weight of tetrahydrofuran is dip-coated on the charge generation layer to obtain a charge transport layer, and thus an electrophotographic photoreceptor is obtained.

The resulting electrophotographic photoreceptor is mounted to a process cartridge for printer (manufactured by Fuji Xerox Co., Ltd., DOCUCENTER COLOR 500) and a wear rate of the photoreceptor after printing 10000 sheets is measured by an eddy current thickness sensor, and also a thermal bending temperature is measured according to HDT 0.45 MPa (ISO 75-2). Furthermore the absence or presence of deposition of the toner onto the electrophotographic photoreceptor is visually evaluated, and the absence or presence of image quality defects is visually evaluated. As used herein, the wear rate refers to an amount of wear of the electrophotographic photoreceptor for every 1000 sheets printed.

Torque between an electrophotographic photoreceptor and a cleaning blade is evaluated by HEIDON (manufactured by Shinto kagaku Co., Ltd. TRIBOGEAR TYPE 941). The results are shown in Table 19.

An exposure light source (manufactured by Fuji Xerox Co., Ltd., DOCUCENTER COLOR 500) has a wavelength of 780 nm.

Examples 2B to 6B

In the same manner as in Example 1B, except that the polymeric compound used in the charge transport layer is replaced by polymeric compounds for Examples 2B to 6B shown in Table 15 and Table 16, electrophotographic photosensitive bodies are obtained and evaluated in the same manner as in Example 1B. The results are shown in Table 19.

Each weight average molecular weight of the polymeric compounds used in Example 2B to 6B is as follows: Example 2B: 35000, Example 3B: 38000, Example 4B: 36000, Example 5B: 40000, and Example 6B: 38000.

TABLE 15

| Partition | Polymeric Compound (Binder Resin) | Charge Transport Material |
|---|---|---|
| Example 1B | 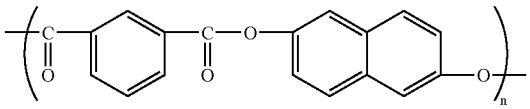 | 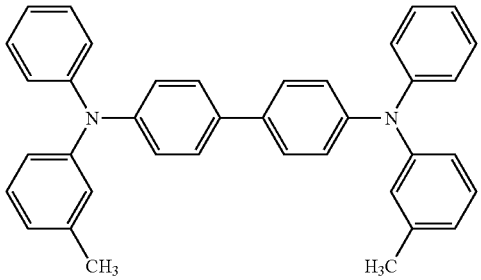 |
| Example 2B | 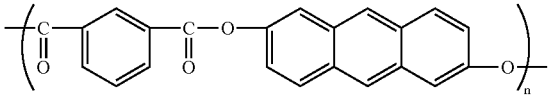 | The same as Example 1B |
| Example 3B | 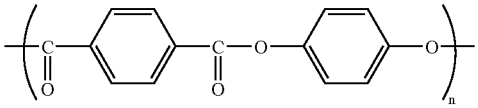 | The same as Example 1B |
| Example 4B | 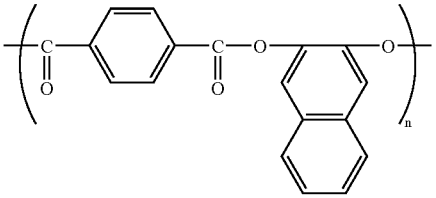 | The same as Example 1B |

TABLE 16

| Partition | Polymeric Compound (Binder Resin) | Charge Transport Material |
|---|---|---|
| Example 5B | 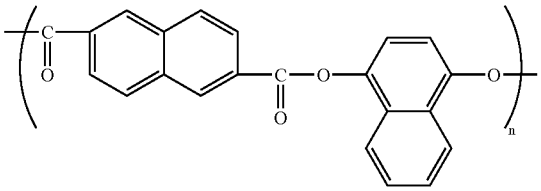 | The same as Example 1B |
| Example 6B | 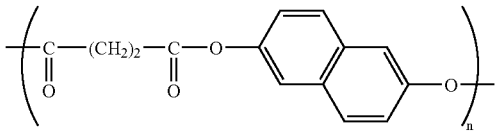 | The same as Example 1B |
| Example 7B | The same as Example 1B | 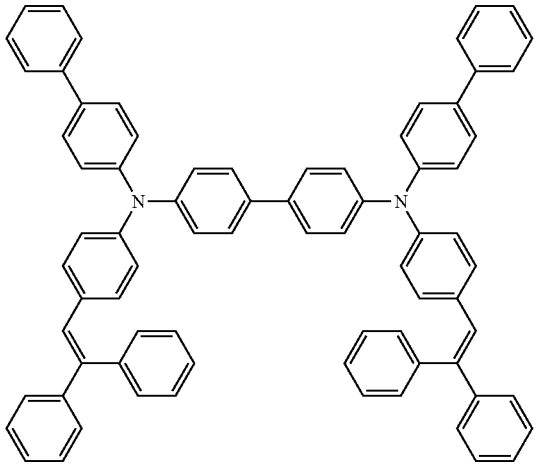 |

Example 7B

In the same manner as in Example 1B, except that the charge transport material used in the charge transport layer is replaced by a compound of Example 7B shown in Table 16, an electrophotographic photoreceptor is obtained and evaluated in the same manner as in Example 1B. The results are shown in Table 19.

Example 8B

In the same manner as in Example 1B, except that 6 parts by weight of hydroxygallium phthalocyanine having strong diffraction peaks at Bragg angles (2θ±0.2°) of 7.5°, 9.9°, 12.5°, 16.3°, 18.6°, 25.1° and 28.3° in an X-ray diffraction spectrum is mixed with 4 parts by weight of a vinyl chloride-vinyl acetate copolymer (manufactured by Nippon Unicar Co., Ltd., VMCH) and 40 parts by weight of butyl acetate and the mixture is dispersed, together with glass beads, using a paint shaker for one hour to obtain a coating solution, and the resulting coating solution is dip-coated on the undercoat layer and then dried with heating at 130° C. for 10 minutes to form an about 0.15 μm thick charge generation layer, an electrophotographic photoreceptor is obtained and evaluated in the same manner as in Example 1B. The results are shown in Table 19.

Example 9B

In the same manner as in Example 1B, except that 0.5 parts by weight of silicone resin fine particles (manufactured by GE Toshiba Silicones Co., Ltd., TOSPEARL 105) is added to a coating solution for charge transport layer and then dispersed, together with glass beads, using a paint shaker for one hour, an electrophotographic photoreceptor is obtained and evaluated in the same manner as in Example 1B. The results are shown in Table 19.

Example 10B

2 Parts by weight of the compound shown in Table 17, 2 parts by weight of methyltrimethoxysilane, 0.5 parts by weight of tetramethoxysilane and 0.3 parts by weight of colloidal silica are dissolved in 5 parts by weight of isopropyl alcohol, 3 parts by weight of tetrahydrofuran and 0.3 parts by weight of distilled water and 0.5 parts by weight of an ion exchange resin (AMBERLIST 15E manufactured by Rhom & Haas Co.) is added, and then the mixture is hydrolyzed for 24 hours by stirring at room temperature.

To a solution prepared by removing the ion exchange resin from the hydrolyzed product due to filtration, 0.1 parts by weight of aluminum trisacetylacetonate (Al (aqaq)$_3$), 0.4 parts by weight of 3,5-di-t-butyl-4-hydroxytoluene (BHT) and 0.02 parts by weight of polytetrafluoroethylene particles (manufactured by DAIKIN INDUSTRIES, LTD., RUBLON L-2) are added. The resulting coating solution is applied on the surface of the electrophotographic photoreceptor obtained in Example 1B by a ring type dip coating method, dried at room temperature for 30 minutes and then cured with heating at 170° C. for one hour to form an about 3 μm thick protective layer, and thus an electrophotographic photoreceptor is obtained. The resulting electrophotographic photoreceptor is evaluated in the same manner as in Example 1B. The results are shown in Table 19.

TABLE 17

| Partition | Compound |
|---|---|
| Example 10B | 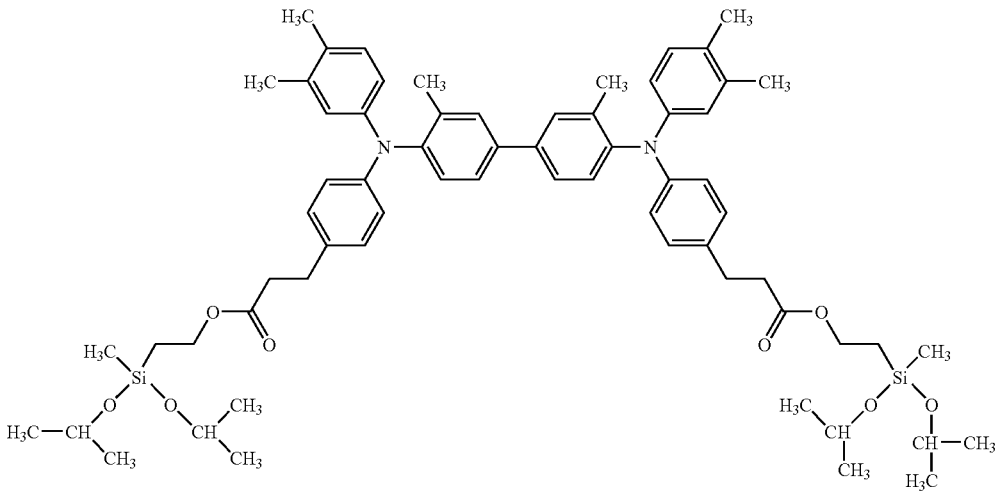 |

Example 11B

Each 2 parts by weight of two kinds of compounds A and B shown in Table 18 and 0.05 parts by weight of tetramethoxysilane are dissolved in 5 parts by weight of isopropyl alcohol, 3 parts by weight of tetrahydrofuran and 0.3 parts by weight of distilled water and 0.05 parts by weight of an ion exchange resin (AMBERLIST 15E manufactured by Rhom & Haas Co.) is added, and then the mixture is hydrolyzed for 24 hours by stirring at room temperature.

The ion exchange resin is removed from the solution by filtration thus obtained a filtrate. To 2 parts by weight of the resulting filtrate, 0.04 parts by weight of aluminum trisacetylacetonate and 0.02 parts by weight of 3,5-di-tert-butyl-4-hydroxytoluene are added to obtain a coating solution. The resulting coating solution is applied on the surface of the electrophotographic photoreceptor obtained in Example 1B by a ring type dip coating method, dried at room temperature for 30 minutes, and then cured with heating at 170° C. for one hour to form an about 3 μm thick protective layer, and thus an electrophotographic photoreceptor is obtained. The resulting electrophotographic photoreceptor is evaluated in the same manner as in Example 1B. The results are shown in Table 19.

TABLE 18

| Partition | Compound A | Compound B |
|---|---|---|
| Example 11B | 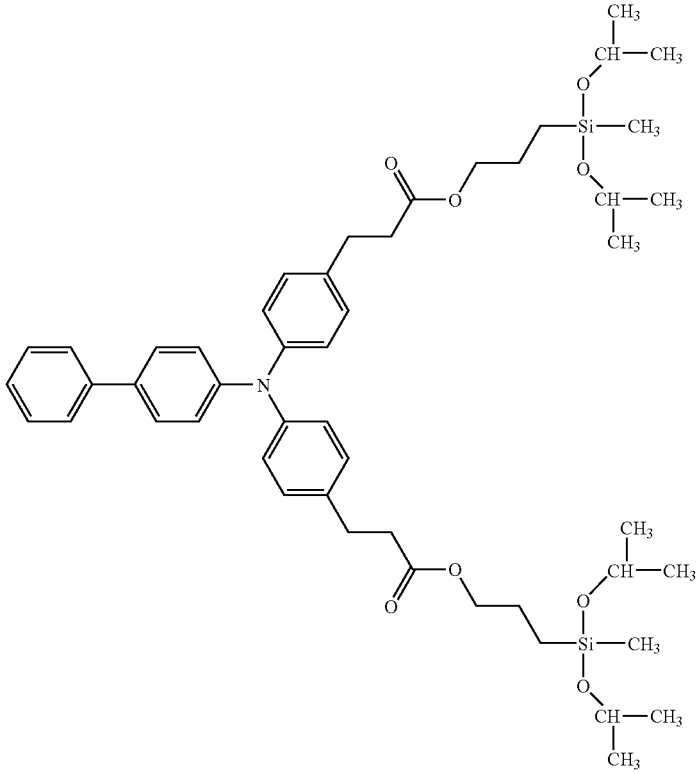 | 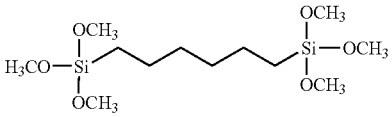 |

Example 12B

With regard to the electrophotographic photoreceptor obtained in Example 1B, in the same manner as in Example 1B, except that, the exposure light source of the printer (manufactured by Fuji Xerox Co., Ltd., DOCUCENTER COLOR 500) is replaced by laser having a wavelength of 405 nm, the evaluation is conducted. The results are shown in Table 19.

Comparative Example 1B

In the same manner as in Example 1B, except that bisphenol Z type polycarbonate (manufactured by MITSUBISHI CHEMICAL CORPORATION, YUPILON Z400, weight average molecular weight:46000) is used as the polymeric compound of the charge transport layer, an electrophotographic photoreceptor is obtained and evaluated in the same manner as in Example 1B. The results are shown in Table 19.

Comparative Example 2B

In the same manner as in Example 1B, except that bisphenol A type polycarbonate (manufactured by TEIJIN LIMITED, PANLITE, weight average molecular weight: 46000) is used as the polymeric compound of the charge transport layer, an electrophotographic photoreceptor is obtained and evaluated in the same manner as in Example 1B. The results are shown in Table 19.

Comparative Example 3B

In the same manner as in Example 1B, except that bisphenol A type polyallylate (manufactured by UNITIKA LTD., U POLYMER, weight average molecular weight: 40000) is used as the polymeric compound of the charge transport layer, an electrophotographic photoreceptor is obtained and evaluated in the same manner as in Example 1B. The results are shown in Table 19.

TABLE 19

| Partition | Wear Rate (nm/1000 sheets) | Thermal Bending Temperature (° C.) | Torque | Deposition | Image Defects |
|---|---|---|---|---|---|
| Example 1B | 15 | 75 | 5.0 | None | None |
| Example 2B | 12 | 78 | 5.0 | None | None |
| Example 3B | 16 | 75 | 5.1 | None | None |

TABLE 19-continued

| Partition | Wear Rate (nm/1000 sheets) | Thermal Bending Temperature (° C.) | Torque | Deposition | Image Defects |
|---|---|---|---|---|---|
| Example 4B | 17 | 72 | 4.8 | None | None |
| Example 5B | 15 | 77 | 5.0 | None | None |
| Example 6B | 17 | 71 | 5.2 | None | None |
| Example 7B | 10 | 74 | 4.4 | None | None |
| Example 8B | 14 | 75 | 4.8 | None | None |
| Example 9B | 15 | 75 | 5.0 | None | None |
| Example 10B | 3 | 120 | 5.8 | None | None |
| Example 11B | 1 | 130 | 6.0 | None | None |
| Example 12B | 15 | 75 | 5.0 | None | None |
| Comparative Example 1B | 45 | 56 | 7.5 | Occurred | Streak-Like Defects |
| Comparative Example 2B | 50 | 55 | 8.0 | Occurred | Streak-Like Defects |
| Comparative Example 3B | 35 | 62 | 8.0 | Occurred | Streak-Like Defects |

Example 1C

100 Parts by weight of zinc oxide (manufactured by TAYCA CORPORATION, SMZ-017N) and 500 parts by weight of toluene are mixed with stirring and 2 parts by weight of a silane coupling agent (manufactured by Nippon Unicar Co., Ltd., A1100) is added, followed by stirring for 5 hours. After toluene is distilled off under reduced pressure, the mixture is baked at 120° C. for 2 hours to obtain surface-treated zinc oxide.

35 Parts by weight of the surface-treated zinc oxide, 15 parts by weight of blocked isocyanate (manufactured by Sumitomo Bayer Urethane Co., Ltd., SUMIJULE 3175) as a curing agent, 6 parts by weight of a butyral resin (manufactured by SEKISUI CHEMICAL CO., LTD., BM-1) and 44 parts by weight of methyl ethyl ketone are mixed and dispersed in a sand mill using 1 mmϕ glass beads for 2 hours to obtain a dispersion.

To the resulting dispersion, 0.005 parts by weight of dioctyltin dilaurate as a catalyst and 17 parts by weight of a silicone resin (manufactured by GE Toshiba Silicones Co., Ltd., TOSPEARL 130) are added to obtain a coating solution for undercoat layer. The resulting coating solution is applied on a 84 mm drawn tube substrate made of a JIS H4080 A3003 alloy by a dip coating method and cured with drying at 160° C. for 100 minutes to obtain a 20 μm thick undercoat layer.

1 Part by weight of chlorogalliumphthalocyanine having strong diffraction peaks at Bragg angles (2θ±0.2°) of 7.4°, 16.6°, 25.5° and 28.3° in an X-ray diffraction spectrum, 1 part by weight of a polybutyral resin (manufactured by SEKISUI CHEMICAL CO., LTD., BM-S) and 100 parts by weight of butyl acetate are mixed and dispersed, together with glass beads, using a paint shaker for one hour to obtain a coating solution. The resulting coating solution is dip-coated on the undercoat layer and then dried with heating at 100° C. for 10 minutes to form an about 0.15 μm thick charge generation layer.

Then, a coating solution prepared by dissolving 3 parts by weight of a polymeric compound (weight average molecular weight: 60000) having a basic structure shown in Table 20 and 2 parts by weight of a benzidine compound shown in Table 20 in 10 parts by weight of toluene is dip-coated on the charge generation layer to obtain a charge transport layer, and thus an electrophotographic photoreceptor is obtained.

The resulting electrophotographic photoreceptor is mounted to a process cartridge for printer (manufactured by Fuji Xerox Co., Ltd., DOCUCENTER COLOR 500) and a wear rate of the photoreceptor after printing 10000 sheets is measured by an eddy current thickness sensor, and also a thermal bending temperature is measured according to HDT 0.45 MPa (ISO 75-2). Furthermore, the absence or presence of deposition of the toner onto the electrophotographic photoreceptor is visually evaluated, and the absence or presence of image quality defects is visually evaluated. As used herein, the wear rate refers to an amount of wear of the electrophotographic photoreceptor for every 1000 sheets printed.

Torque between an electrophotographic photoreceptor and a cleaning blade is evaluated by HEIDON (manufactured by Shinto kagaku Co., Ltd. TRIBOGEAR TYPE 941).

With regard to the binder resin used in the charge transport layer, saturation solubility in toluene is measured. The results are shown in Table 23.

Examples 2C to 6C

In the same manner as in Example 1C, except that the polymeric compound used in the charge transport layer is replaced by polymeric compounds for Examples 2C to 6C shown in Table 20 and Table 21, electrophotographic photosensitive bodies are obtained and evaluated in the same manner as in Example 1C. The results are shown in Table 23.

Each weight average molecular weight of the polymeric compounds used in Example 2C to 6C is as follows: Example 2C: 36000, Example 3C: 38000, Example 4C: 42000, Example 5C: 40000, and Example 6C: 42000.

TABLE 20
| Partition | Polymeric Compound (Binder Resin) | Charge Transport Material |
|---|---|---|
| Example 1C | 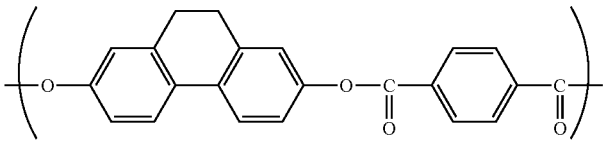 | 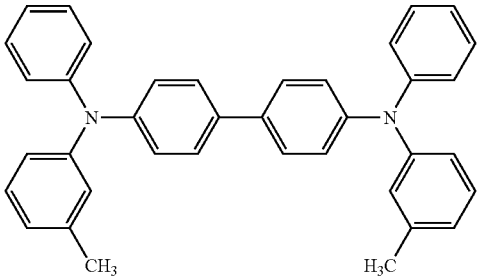 |
| Example 2C | 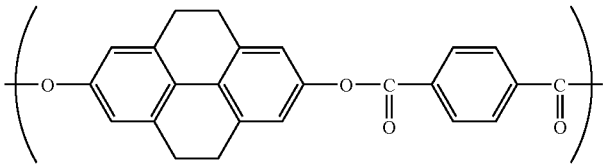 | The same as Table 1C |
| Example 3C | 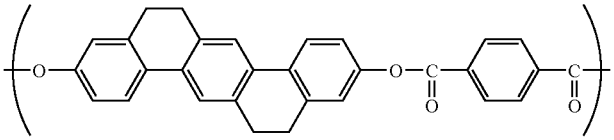 | The same as Table 1C |
| Example 4C | 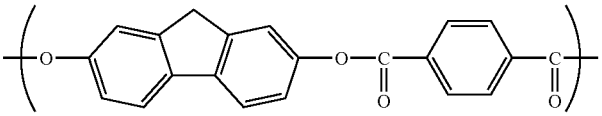 | The same as Table 1C |
TABLE 21
| Partition | Polymer Compound (Binder Resin) | Charge Transport Material |
|---|---|---|
| Example 5C | 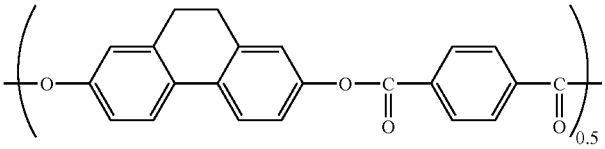 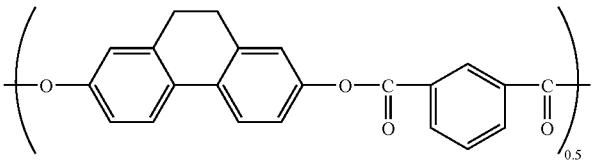 | The same as Example 1C |
| Example 6C | 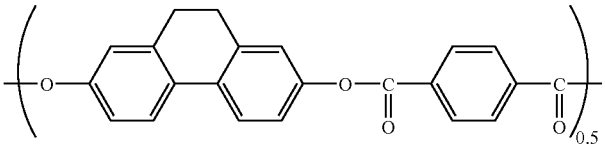 | The same as Example 1C |

TABLE 21-continued

| Partition | Polymer Compound (Binder Resin) | Charge Transport Material |
|---|---|---|
| | 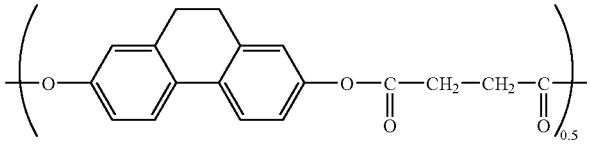 | |

Example 7C

In the same manner as in Example 1C, except that the charge transport material used in the charge transport layer is replaced by a compound of Example 7C shown in Table 22, an electrophotographic photoreceptor is obtained and evaluated in the same manner as in Example 1C. The results are shown in Table 23.

TABLE 22

| Partition | Polymeric Compound (Binder Resin) | Charge Transport Material |
|---|---|---|
| Example 7C | The same as Example 1C | 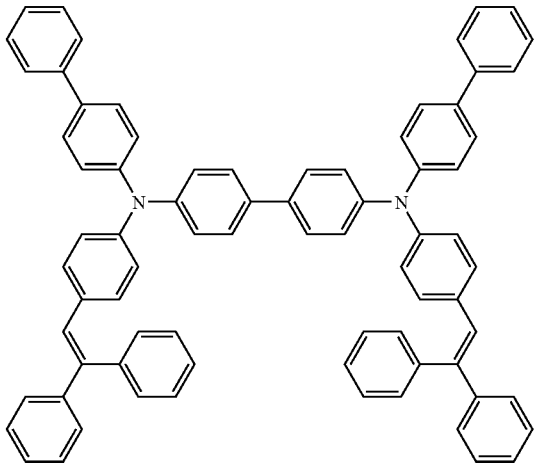 |

Example 8C

In the same manner as in Example 1C, except that 6 parts by weight of hydroxygallium phthalocyanine having strong diffraction peaks at Bragg angles (2θ±0.2°) of 7.5°, 9.9°, 12.5°, 16.3°, 18.6°, 25.1° and 28.3° in an X-ray diffraction spectrum is mixed with 4 parts by weight of a vinyl chloride-vinyl acetate copolymer (manufactured by Nippon Unicar Co., Ltd., VMCH) and 40 parts by weight of butyl acetate and the mixture is dispersed, together with glass beads, using a paint shaker for one hour to obtain a coating solution, and the resulting coating solution is dip-coated on the undercoat layer and then dried with heating at 130° C. for 10 minutes to form an about 0.15 μm thick charge generation layer, an electrophotographic photoreceptor is obtained and evaluated in the same manner as in Example 1C. The results are shown in Table 23.

Example 9C

In the same manner as in Example 1C, except that 0.5 parts by weight of silicone resin fine particles (manufactured by GE Toshiba Silicones Co., Ltd.,TOSPEARL 105) is added to a coating solution for charge transport layer and then dispersed, together with glass beads, using a paint shaker for one hour, an electrophotographic photoreceptor is obtained and evaluated in the same manner as in Example 1C. The results are shown in Table 23.

Example 10C

2 Parts by weight of the compound shown in Table 17, 2 parts by weight of methyltrimethoxysilane, 0.5 parts by weight of tetramethoxysilane and 0.3 parts by weight of colloidal silica are dissolved in 5 parts by weight of isopropyl alcohol, 3 parts by weight of tetrahydrofuran and 0.3 parts by weight of distilled water and 0.5 parts by weight of an ion exchange resin (AMBERLIST 15E manufactured by Rhom & Haas Co.) is added, and then the mixture is hydrolyzed for 24 hours by stirring at room temperature.

To a solution prepared by removing the ion exchange resin from the hydrolyzed product due to filtration, 0.1 parts by weight of aluminum trisacetylacetonate (Al (aqaq)$_3$), 0.4 parts by weight of 3,5-di-t-butyl-4-hydroxytoluene (BHT) and 0.02 parts by weight of polytetrafluoroethylene particles (manufactured by DAIKIN INDUSTRIES, LTD., RUBLON L-2) are added. The resulting coating solution is applied on the surface of the electrophotographic photoreceptor obtained in Example 1C by a ring type dip coating method, dried at room temperature for 30 minutes and then cured with heating at 170° C. for one hour to form an about 3 μm thick protective layer, and thus an electrophotographic photoreceptor is obtained. The resulting electrophotographic photoreceptor is evaluated in the same manner as in Example 1C. The results are shown in Table 23.

Example 11C

Each 2 parts by weight of two kinds of compounds A and B shown in Table 18 and 0.05 parts by weight of tetramethoxysilane are dissolved in 5 parts by weight of isopropyl alcohol, 3 parts by weight of tetrahydrofuran and 0.3 parts by weight of distilled water and 0.05 parts by weight of an ion exchange resin (AMBERLIST 15E manufactured by Rhom & Haas Co.) is added, and then the mixture is hydrolyzed for 24 hours by stirring at room temperature.

The ion exchange resin is removed from the solution by filtration, thus obtained a filtrate. To 2 parts by weight of the resulting filtrate, 0.04 parts by weight of aluminum trisacetylacetonate and 0.02 parts by weight of 3,5-di-tert-butyl-4-hydroxytoluene are added to obtain a coating solution. The resulting coating solution is applied on the surface of the electrophotographic photoreceptor obtained in Example 1C by a ring type dip coating method, dried at room temperature for 30 minutes, and then cured with heating at 170° C. for one hour to form an about 3 μm thick protective layer, and thus an electrophotographic photoreceptor is obtained. The resulting electrophotographic photoreceptor is evaluated in the same manner as in Example 1C. The results are shown in Table 23.

Example 12C

In the same manner as in Example 1C, except that a coating solution prepared by dispersing t-selenium and a vinyl chloride-vinyl acetate copolymer (manufactured by Nippon Unicar Co., Ltd., VMCH) at a weight ratio of 6:4 in butyl acetate is dip-coated onto an aluminum substrate to obtain a 10 μm thick charge generation layer, an electrophotographic photoreceptor is obtained.

With regard to the resulting electrophotographic photoreceptor, in the same manner as in Example 1C, except that, the exposure light source of the printer (manufactured by Fuji Xerox Co., Ltd., DOCUCENTER COLOR 500) is replaced by laser having a wavelength of 405 nm, the evaluation is conducted. The results are shown in Table 23.

Comparative Example 1C

In the same manner as in Example 1C, except that bisphenol Z type polycarbonate (manufactured by MITSUBISHI CHEMICAL CORPORATION, YUPILON Z400, weight average molecular weight: 46000) is used as the polymeric compound of the charge transport layer, an electrophotographic photoreceptor is obtained and evaluated in the same manner as in Example 1C. The results are shown in Table 23.

Comparative Example 2C

In the same manner as in Example 1C, except that bisphenol A type polycarbonate (manufactured by TEIJIN LIMITED, PANLITE, weight average molecular weight: 46000) is used as the polymeric compound of the charge transport layer, an electrophotographic photoreceptor is obtained and evaluated in the same manner as in Example 1C. The results are shown in Table 23.

Comparative Example 3C

In the same manner as in Example 1C, except that bisphenol A type polyallylate (manufactured by UNITIKA LTD., U POLYMER, weight average molecular weight: 40000) is used as the polymeric compound of the charge transport layer, an electrophotographic photoreceptor is obtained and evaluated in the same manner as in Example 1C. The results are shown in Table 23.

TABLE 23

| Partition | Wear Rate (nm/1000 sheets) | Thermal Bending Temperature (° C.) | Torque | Deposition | Image Defects | Saturation Solubility in Toluene (% by weight) |
|---|---|---|---|---|---|---|
| Example 1C | 10 | 80 | 5.5 | None | None | 50 |
| Example 2C | 7 | 85 | 5.4 | None | None | 45 |
| Example 3C | 8 | 78 | 5.7 | None | None | 55 |
| Example 4C | 8 | 82 | 5.4 | None | None | 45 |
| Example 5C | 14 | 75 | 5.7 | None | None | 60 |
| Example 6C | 16 | 72 | 5.8 | None | None | 60 |
| Example 7C | 10 | 82 | 5.4 | None | None | 50 |
| Example 8C | 10 | 80 | 5.5 | None | None | 50 |
| Example 9C | 7 | 81 | 5.0 | None | None | 50 |
| Example 10C | 3 | 120 | 5.8 | None | None | 50 |
| Example 11C | 1 | 130 | 6.0 | None | None | 50 |
| Example 12C | 10 | 80 | 5.5 | None | None | 50 |
| Comparative Example 1C | 45 | 56 | 7.5 | Occurred | Streak-Like Defects | 10 |
| Comparative Example 2C | 50 | 55 | 8.0 | Occurred | Streak-Like Defects | 8 |
| Comparative Example 3C | 35 | 62 | 8.0 | Occurred | Streak-Like Defects | 5 |

As is apparent from Table 19 and Table 23, the electrophotographic photosensitive bodies comprising at least one layer containing the polymeric compound having a repeating unit represented by general formula (II) of the invention have markedly high wear resistance and high heat resistance. Since low torque to a cleaning blade enables strong cleaning, deposition of the toner, as a feature of the electrophotographic photoreceptor having high wear resistance, is not observed and thus image quality of the image forming apparatus of the invention is excellent.

As is apparent from Table 23, the polymeric compound having a repeating unit represented by general formula (II) has high solubility in an organic solvent, and thus making it possible to drastically reduce the amount of the organic solvent required to prepare a coating solution for charge transport layer, resulting in less environmental burden.

On the other hand, the electrophotographic photosensitive bodies shown in Comparative Example 1C to 3C, which are not within the scope of the invention, have poor wear resistance and poor heat resistance. These electrophotographic photosensitive bodies are not capable of strong cleaning because of high torque to a cleaning blade, and thus the toner is deposited to cause image defects.

As is apparent from Comparative Examples 1C to 3C, a large amount of the organic solvent is required to prepare a coating solution for charge transport layer because of poor solubility in the organic solvent, resulting in severe environmental burden.

Examples and Comparative Examples Using a Polymeric Compound Having a Repeating Unit Represented by General Gormula (III)

Example 1D

100 Parts by weight of zinc oxide (manufactured by TAYCA CORPORATION, SMZ-017N) and 500 parts by weight of toluene are mixed with stirring and 2 parts by weight of a silane coupling agent (manufactured by Nippon Unicar Co., Ltd., A1100) is added, followed by stirring for 5 hours. After toluene is distilled off under reduced pressure, the mixture is baked at 120° C. for 2 hours to obtain surface-treated zinc oxide.

35 Parts by weight of the surface-treated zinc oxide, 15 parts by weight of blocked isocyanate (manufactured by Sumitomo Bayer Urethane Co., Ltd., SUMIJULE 3175) as a curing agent, 6 parts by weight of a butyral resin (manufactured by SEKISUI CHEMICAL CO., LTD., BM-1) and 44 parts by weight of methyl ethyl ketone are mixed and dispersed in a sand mill using 1 mmϕ glass beads for 2 hours to obtain a dispersion.

To the resulting dispersion, 0.005 parts by weight of dioctyltin dilaurate as a catalyst and 17 parts by weight of a silicone resin (manufactured by GE Toshiba Silicones Co., Ltd., TOSPEARL 130) are added to obtain a coating solution for undercoat layer. The resulting coating solution is applied on a 84 mm drawn tube substrate made of a JIS H4080 A3003 alloy by a dip coating method and cured with drying at 160° C. for 100 minutes to obtain a 20 μm thick undercoat layer.

1 Part by weight of chlorogalliumphthalocyanine having strong diffraction peaks at Bragg angles (2θ±0.2°) of 7.4°, 16.6°, 25.5° and 28.3° in an X-ray diffraction spectrum, 1 part by weight of a polybutyral resin (manufactured by SEKISUI CHEMICAL CO., LTD., BM-S) and 100 parts by weight of butyl acetate are mixed and dispersed, together with glass beads, using a paint shaker for one hour to obtain a coating solution. The resulting coating solution is dip-coated on the undercoat layer and then dried with heating at 100° C. for 10 minutes to form an about 0.15 μm thick charge generation layer.

Then, a coating solution prepared by dissolving 3 parts by weight of a polymeric compound (weight average molecular weight: 45000) having a basic structure shown in Table 24 and 2 parts by weight of a benzidine compound shown in Table 24 in 10 parts by weight of toluene is dip-coated on the charge generation layer to obtain a charge transport layer, and thus an electrophotographic photoreceptor is obtained.

The resulting electrophotographic photoreceptor is mounted to a process cartridge for printer (manufactured by Fuji Xerox Co., Ltd., DOCUCENTER COLOR 500) and a wear rate of the photoreceptor after printing 10000 sheets is measured by an eddy current thickness sensor, and also a thermal bending temperature is measured according to HDT 0.45 MPa (ISO 75-2). Furthermore, the absence or presence of solvent cracks is visually evaluated. Also the absence or presence of deposition of the toner onto the electrophotographic photoreceptor is visually evaluated, and the absence or presence of image quality defects is visually evaluated. As used herein, the wear rate refers to an amount of wear of the electrophotographic photoreceptor for every 1000 sheets printed.

Torque between an electrophotographic photoreceptor and a cleaning blade is evaluated by HEIDON (manufactured by Shinto kagaku Co., Ltd. TRIBOGEAR TYPE 941). The results are shown in Table 28.

An exposure light source (manufactured by Fuji Xerox Co., Ltd., DOCUCENTER COLOR 500) has a wavelength of 780 nm. [Examples 2D to 6D]

In the same manner as in Example 1D, except that the polymeric compound used in the charge transport layer is replaced by polymeric compounds for Examples 2D to 6D shown in Table 24 and Table 25, electrophotographic photosensitive bodies are obtained and evaluated in the same manner as in Example 1D. The results are shown in Table 28.

Each weight average molecular weight of the polymeric compounds used in Example 2D to 6D is as follows: Example 2D: 42000, Example 3D: 51000, Example 4D: 40000, Example 5D: 43000, and Example 6D: 62000.

TABLE 24
| Partition | Polymeric Compound (Binder Resin) | Charge Transport Material |
|---|---|---|
| Example 1D | 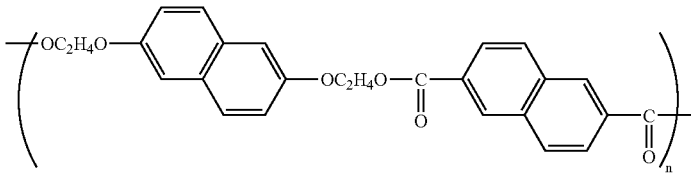 | 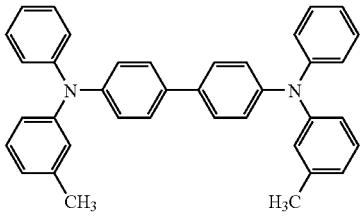 |
| Example 2D | 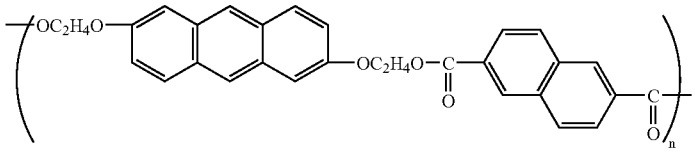 | The same as Example 1D |
| Example 3D | 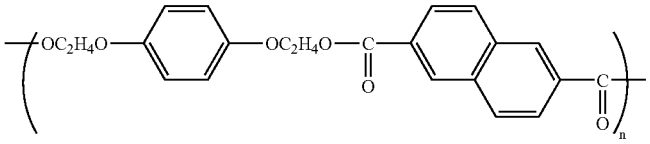 | The same as Example 1D |
| Example 4D | 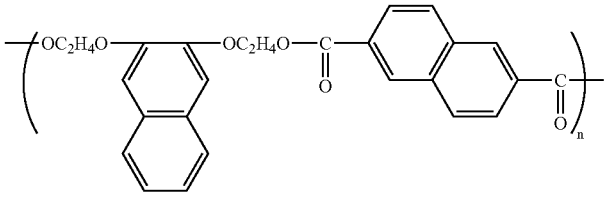 | The same as Example 1D |

TABLE 25

| Partition | Polymeric Compound (Binder Resin) | Charge Transport Material |
|---|---|---|
| Example 5D | 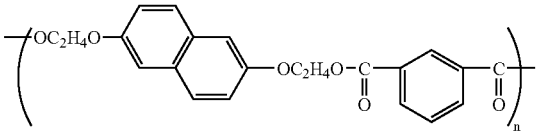 | The same as Example 1D |
| Example 6D | 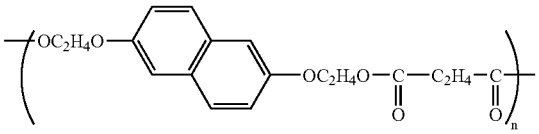 | The same as Example 1D |
| Example 7D | The same as Example 1D | 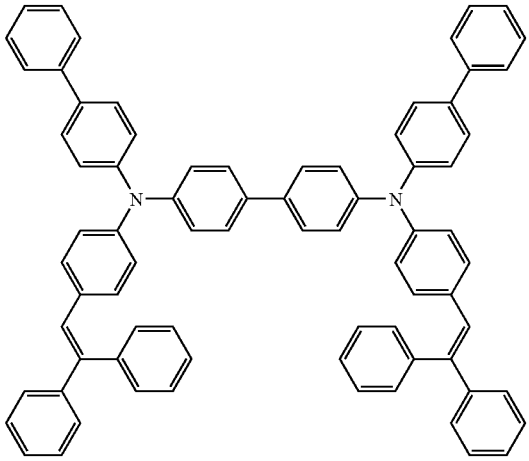 |

Example 7D

In the same manner as in Example 1D, except that the charge transport material used in the charge transport layer is replaced by a compound of Example 7D shown in Table 25, an electrophotographic photoreceptor is obtained and evaluated in the same manner as in Example 1D. The results are shown in Table 28.

Example 8D

In the same manner as in Example 1D, except that 6 parts by weight of hydroxygallium phthalocyanine having strong diffraction peaks at Bragg angles (2θ±0.2°) of 7.5°, 9.9°, 12.5°, 16.3°, 18.6°, 25.1° and 28.3° in an X-ray diffraction spectrum is mixed with 4 parts by weight of a vinyl chloride-vinyl acetate copolymer (manufactured by Nippon Unicar Co., Ltd., VMCH) and 40 parts by weight of butyl acetate and the mixture is dispersed, together with glass beads, using a paint shaker for one hour to obtain a coating solution, and the resulting coating solution is dip-coated on the undercoat layer and then dried with heating at 130° C. for 10 minutes to form an about 0.15 μm thick charge generation layer, an electrophotographic photoreceptor is obtained and evaluated in the same manner as in Example 1D. The results are shown in Table 28.

Example 9D

In the same manner as in Example 1D, except that 0.5 parts by weight of silicone resin fine particles (manufactured by GE Toshiba Silicones Co., Ltd., TOSPEARL 105) is added to a coating solution for charge transport layer and then dispersed, together with glass beads, using a paint shaker for one hour, an electrophotographic photoreceptor is obtained and evaluated in the same manner as in Example 1D. The results are shown in Table 28.

Example 10D

2 Parts by weight of the compound shown in Table 26, 2 parts by weight of methyltrimethoxysilane, 0.5 parts by weight of tetramethoxysilane and 0.3 parts by weight of colloidal silica are dissolved in 5 parts by weight of isopropyl alcohol, 3 parts by weight of tetrahydrofuran and 0.3 parts by weight of distilled water and 0.5 parts by weight of an ion exchange resin (AMBERLIST 15 E manufactured by Rhom & Haas Co.) is added, and then the mixture is hydrolyzed for 24 hours by stirring at room temperature.

To a solution prepared by removing the ion exchange resin from the hydrolyzed product due to filtration, 0.1 parts by weight of aluminum trisacetylacetonate (Al (aqaq)$_3$), 0.4 parts by weight of 3,5-di-t-butyl-4-hydroxytoluene (BHT) and 0.02 parts by weight of polytetrafluoroethylene particles (manufactured by DAIKIN INDUSTRIES, LTD., RUBLON L-2) are added. The resulting coating solution is applied on the surface of the electrophotographic photoreceptor obtained in Example 1D by a ring type dip coating method, dried at room temperature for 30 minutes and then cured with heating at 170° C. for one hour to form an about 3 μm thick protective layer, and thus an electrophotographic photoreceptor is obtained. The resulting electrophotographic photoreceptor is evaluated in the same manner as in Example 1D. The results are shown in Table 28.

TABLE 26

| Partition | Compound |
|---|---|
| Example 10D | 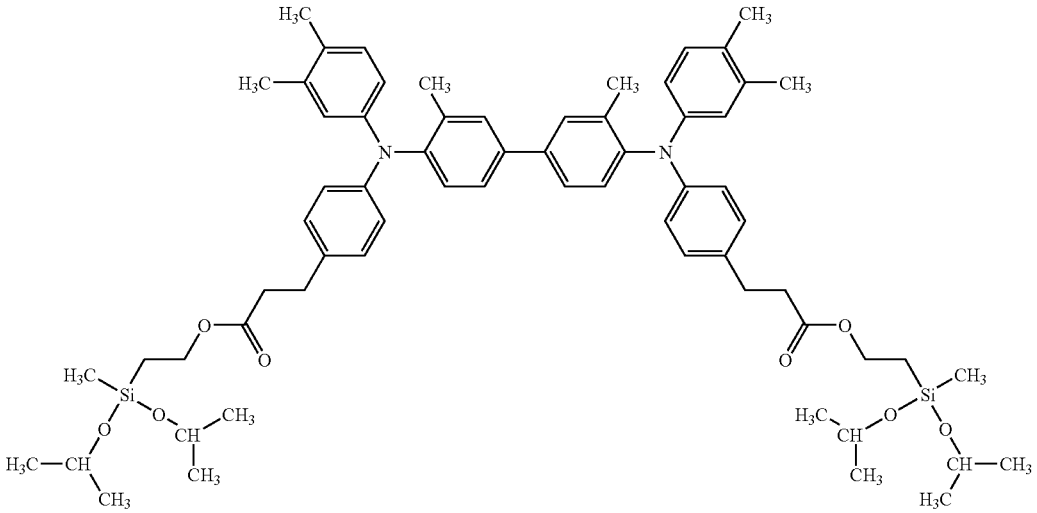 |

Example 11D

Each 2 parts by weight of two kinds of compounds A and B shown in Table 27 and 0.05 parts by weight of tetramethoxysilane are dissolved in 5 parts by weight of isopropyl alcohol, 3 parts by weight of tetrahydrofuran and 0.3 parts by weight of distilled water and 0.05 parts by weight of an ion exchange resin (AMBERLIST 14 E manufactured by Rhom & Haas Co.) is added, and then the mixture is hydrolyzed for 24 hours by stirring at room temperature.

The ion exchange resin is removed from the solution by filtration, thus obtained a filtrate. To 2 parts by weight of the resulting filtrate, 0.04 parts by weight of aluminum trisacetylacetonate and 0.02 parts by weight of 3,5-di-tert-butyl-4-hydroxytoluene are added to obtain a coating solution. The resulting coating solution is applied on the surface of the electrophotographic photoreceptor obtained in Example 1D by a ring type dip coating method, dried at room temperature for 30 minutes, and then cured with heating at 170° C. for one hour to form an about 3 μm thick protective layer, and thus an electrophotographic photoreceptor is obtained. The resulting electrophotographic photoreceptor is evaluated in the same manner as in Example 1D. The results are shown in Table 28.

TABLE 27

| Partition | Compound A | Compound B |
|---|---|---|
| Example 11D | 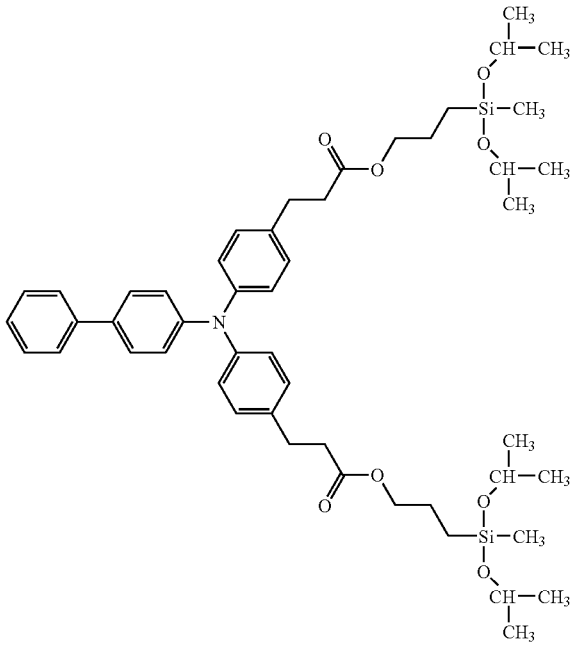 | 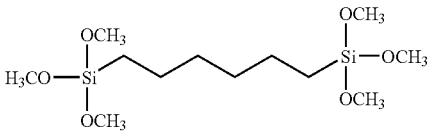 |

Example 12D

With regard to the electrophotographic photoreceptor obtained in Example 1D, in the same manner as in Example 1D, except that, the exposure light source of the printer (manufactured by Fuji Xerox Co., Ltd., DOCUCENTER COLOR 500) is replaced by laser having a wavelength of 405 nm, the evaluation is conducted. The results are shown in Table 28.

Comparative Example 1D

A trial of producing an electrophotographic photoreceptor was made in the same manner as in Example 1D, except that bisphenol Z type polycarbonate (manufactured by MITSUBISHI CHEMICAL CORPORATION, YUPILON Z400) is used as the polymeric compound of the charge transport layer. However, since bisphenol Z type polycarbonate can not be dissolved in the coating solution for charge transport layer in the case of the concentration in Example 1D, 40 parts by weight of toluene is used as the solvent to obtain an electrophotographic photoreceptor and the resulting electrophotographic photoreceptor is evaluated in the same manner as in Example 1D. The results are shown in Table 28.

Comparative Example 2D

In the same manner as in Example 1D, except that bisphenol A type polycarbonate (manufactured by TEIJIN LIMITED, PANLITE) is used as the polymeric compound of the charge transport layer and 60 parts by weight of toluene is used as the solvent for the same reason as in Comparative Example 1D, an electrophotographic photoreceptor is obtained and evaluated in the same manner as in Example 1D. The results are shown in Table 28.

Comparative Example 3D

In the same manner as in Example 1D, except that bisphenol A type polyallylate (manufactured by UNITIKA LTD., U POLYMER) is used as the polymeric compound of the charge transport layer and 50 parts by weight of toluene is used as the solvent for the same reason as in Comparative Example 1D, an electrophotographic photoreceptor is obtained and evaluated in the same manner as in Example 1D. The results are shown in Table 28.

TABLE 28

| Partition | Solid Content of Coating Solution for Charge Transport Layer (% by weight) | Wear Rate (nm/1000 sheets) | Thermal Bending Temperature(° C.) | Torque | Solvent Crack | Deposition | Image Defects |
|---|---|---|---|---|---|---|---|
| Example 1D | 33 | 10 | 70 | 5.8 | None | None | None |
| Example 2D | 33 | 8 | 72 | 5.7 | None | None | None |
| Example 3D | 33 | 14 | 68 | 5.8 | None | None | None |
| Example 4D | 33 | 12 | 69 | 5.8 | None | None | None |

TABLE 28-continued

| Partition | Solid Content of Coating Solution for Charge Transport Layer (% by weight) | Wear Rate (nm/1000 sheets) | Thermal Bending Temperature(° C.) | Torque | Solvent Crack | Deposition | Image Defects |
|---|---|---|---|---|---|---|---|
| Example 5D | 33 | 11 | 68 | 5.7 | None | None | None |
| Example 6D | 33 | 15 | 67 | 5.8 | None | None | None |
| Example 7D | 33 | 10 | 69 | 5.7 | None | None | None |
| Example 8D | 33 | 10 | 70 | 5.8 | None | None | None |
| Example 9D | 35.5 | 10 | 70 | 5.8 | None | None | None |
| Example 10D | 33 | 3 | 120 | 5.8 | None | None | None |
| Example 11D | 33 | 1 | 130 | 6.0 | None | None | None |
| Example 12D | 33 | 10 | 70 | 5.8 | None | None | None |
| Comparative Example 1D | 11 | 45 | 56 | 7.5 | Occurred | Occurred | Streak-Like Defects |
| Comparative Example 2D | 8 | 50 | 55 | 8.0 | Occurred | Occurred | Streak-Like Defects |
| Comparative Example 3D | 9 | 35 | 62 | 8.0 | Occurred | Occurred | Streak-Like Defects |

As is apparent from Table 28, the electrophotographic photosensitive bodies comprising at least one layer containing a polymeric compound having a repeating unit represented by general formula (III) of the invention have high mechanical strength and high heat resistance, and therefore have markedly high wear resistance. Since low torque to a cleaning blade enables strong cleaning, deposition of the toner, as a feature of the electrophotographic photoreceptor having high wear resistance, is not observed and thus image quality of the image forming apparatus of the invention is excellent. Furthermore, the concentration of the coating solution for charge transport layer of the invention can be increased, that is, the amount of the organic solvent to be used can be drastically reduced and the coating solution is free from a hormone disrupting chemical, resulting in less environmental burden.

On the other hand, the electrophotographic photosensitive bodies shown in Comparative Example 1D to 3D, which are not within the scope of the invention, have poor wear resistance because of low mechanical strength and poor heat resistance, and are not capable of strong cleaning because of high torque to a cleaning blade, and thus the toner is deposited to cause image defects. Furthermore, the concentration of the coating solution for charge transport layer can not be increased and a large amount of an organic solvent is required, and also the coating solution contains a hormone disrupting chemical such as bisphenols, resulting in severe environmental burden.

The electrophotographic photoreceptor of the invention has high heat resistance and high wear resistance and causes no solvent cracks, and is also capable of lowering a torque to a cleaning blade. Furthermore, it enables sufficient cleaning because of low torque to the cleaning blade, and thus causes no deposition of the toner.

According to the image forming apparatus of the invention, an image having high image quality can be formed.

What is claimed is:

1. An electrophotographic photoreceptor comprising a conductive substrate, and at least one layer, which contains a polymeric compound having a repeating unit selected from repeating units represented by the following general formulas (I), (II) or (II), provided on the conductive substrate, (I)

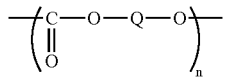

(II)

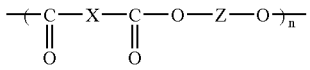

(III)

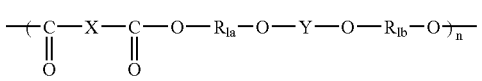

wherein in general formulas (I), (II) or (III), $R_{1a}$ and $R_{1b}$ each independently represent an alkylene group having 1 to 6 carbon atoms, X represents a substituted or unsubstituted arylene group, or a substituted or unsubstituted alkylene group, Y is selected from the group of structures consisting of (IV), (V), (VI), (VII), (VIII), (IX), (X) and (XI), Q is selected from the group of structures consisting of (VIII), (X) and (XI), Z is selected from the group consisting of (VIII), (IX), (X) and (XI), and n represents a repeating unit number, (IV)

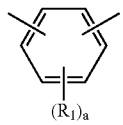

(V)

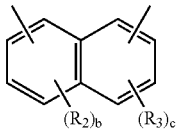

(VI)

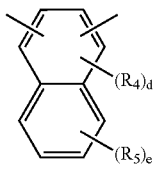

-continued (VII)

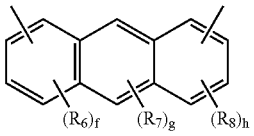

(VIII)

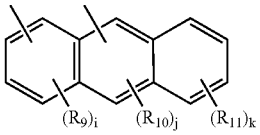

(IX)

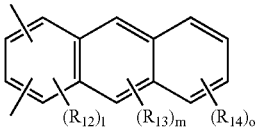

(X)

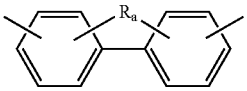

(XI)

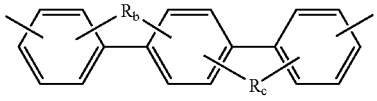

wherein in general formulas (IV) to (IX), $R_1$ to $R_{14}$ each independently represent an alkyl group having 1 to 10 carbon atoms, an aryl group having 6 to 14 carbon atoms, or a substituent containing silicon; a, e, k and o each independently represent an integer from 0 to 4; b, c, f, h and i each independently represent an integer from 0 to 3; d, g, 1 and m each independently represent an integer from 0 to 2; and j represents 0 or 1, in general formulas (X) and (XI), $R_a$ to $R_c$ each independently represent a substituted or unsubstituted alkylene group having 1 to 10 carbon atoms, or a divalent substituent containing silicon, and one or more of $R_a$, $R_b$ or $R_c$ may be present in a plurality in the respective formulas.

2. An electrophotographic photoreceptor according to claim 1, wherein the polymeric compound having a repeating unit represented by general formula (I) is prepared by a process for melt polycondensation or solid phase polymerization of at least a diol represented by the following general formula (XII) and diphenyl carbonate, wherein in general formula (XII), Y is defined as Q in general formula (I).

3. An electrophotographic photoreceptor according to claim 1, wherein the polymeric compound having a repeating unit represented by general formula (II) is prepared by a process for solution polymerization or interfacial polymerization of at least an acid chloride represented by the following general formula (XIII) and a diol represented by the following general formula (XIV), (XIII)

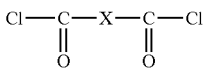

(XIV)

wherein in general formulas (XIII) and (XIV), X and Z are as defined in general formula (II).

4. An electrophotographic photoreceptor according to claim 1, wherein the polymeric compound having a repeating unit represented by general formula (II) is prepared by a process for direct polycondensation of at least dicarboxylic acid represented by the following general formula (XV) and a diol represented by the following general formula (XIV), (XIV)

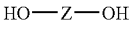

(XV)

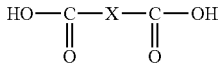

wherein in general formulas (XIV) and (XV), X and Z are as defined in general formula (II).

5. An electrophotographic photoreceptor according to claim 1, wherein the polymeric compound having a repeating unit represented by general formula (III) is prepared by a process for melt polycondensation or solid phase polymerization of at least a dicarboxylic acid derivative represented by the following general formula (XVI) and a diol represented by the following general formula (XVII), (XVI)

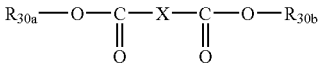

(XVII)

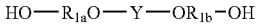

wherein in general formula (XVI), $R_{30a}$ and $R_{30b}$ each independently represent a hydrogen atom, an alkyl group having 1 to 6 carbon atoms, or an aryl group; and X is as defined in general formula (III), and wherein in general formula (XVII), $R_{1a}$, $R_{1b}$ and Y are as defined in general formula (III).

6. An electrophotographic photoreceptor according to claim 1, wherein at least one layer, which contains a polymeric compound having a repeating unit selected from repeating units represented by general formulas (I), (II) or (III), is a charge transport layer.

7. An electrophotographic photoreceptor according to claim 1, wherein at least one layer, which contains a polymeric compound having a repeating unit selected from repeating units represented by general formulas (I), (II) or (III), is a surface layer.

8. An electrophotographic photoreceptor according to claim 7, wherein the surface layer is a charge transport layer or a charge generation layer.

9. An electrophotographic photoreceptor according to claim 1, comprising a layer which contains silicon-containing fine particles and/or fluorine-containing fine particles.

10. An electrophotographic photoreceptor according to claim 6, wherein the charge transport layer contains at least one compound selected from the group consisting of (XVIII), (XIX) and (XX), (XVIII)

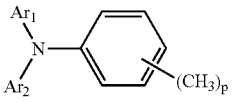

-continued (XIX)

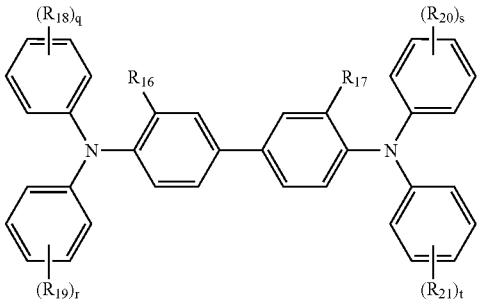

(XX)

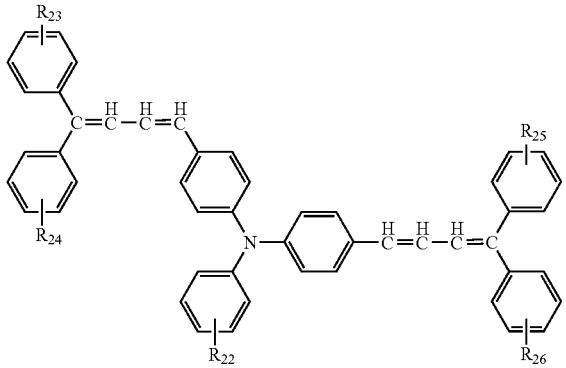

wherein:

in general formula (XVIII), p represents an integer from 0 to 2, $Ar_1$ and $Ar_2$ each independently represent a substituted or unsubstituted aryl group, and the substituents of the substituted aryl group represents an alkyl group having 1 to 5 carbon atoms, an alkoxy group having 1 to 5 carbon atoms, a substituted amino group substituted with at least one alkyl group having 1 to 3 carbon atoms, or a halogen atom;

in general formula (XIX), $R_{16}$ and $R_{17}$ each independently represent an alkyl group having 1 to 5 carbon atoms, an alkoxy group having 1 to 5 carbon atoms, or a halogen atom, $R_{18}$ to $R_{21}$ each independently represent an alkyl group having 1 to 5 carbon atoms, an alkoxy group having 1 to 5 carbon atoms, a substituted amino group substituted with at least one alkyl group having 1 to 2 carbon atoms, a substituted or unsubstituted aryl group, or a structure represented by the following general formula (XXI) or the following general formula (XXII), and q to t each independently represent an integer from 0 to 2; and in general formula (XX), $R_{22}$ represents hydrogen atom, an alkyl group having 1 to 5 carbon atoms, an alkoxy group having 1 to 5 carbon atoms, a substituted or unsubstituted aryl group, or a structure represented by the following general formula (XXI) or the following general formula (XXII); $R_{23}$ to $R_{26}$ each independently represent a hydrogen atom, an alkyl group having 1 to 5 carbon atoms, an alkoxy group having 1 to 5 carbon atoms, a substituted amino group substituted with at least one alkyl group having 1 to 2 carbon atoms, or a substituted or unsubstituted aryl group, (XXI)

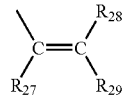

(XXII)

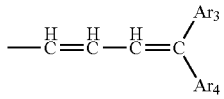

wherein in general formula (XXI), $R_{27}$ to $R_{29}$ each independently represent a hydrogen atom, a substituted or unsubstituted alkyl group, or a substituted or unsubstituted aryl group, and in general formula (XXII), $Ar_3$ and $Ar_4$ each independently represent a substituted or unsubstituted aryl group.

11. An electrophotographic photoreceptor according to claim 1, comprising a protective layer which contains a siloxane resin having charge transport properties and a crosslinked structure.

12. An electrophotographic photoreceptor according to claim 1, comprising a charge generation layer, which contains a phthalocyanine pigment.

13. An electrophotographic photoreceptor according to claim 1, comprising an undercoat layer containing zinc oxide or titanium oxide.

14. An electrophotographic process cartridge comprising at least the electrophotographic photoreceptor according to claim 1.

15. An image forming apparatus comprising:

the electrophotographic photoreceptor according to claim 1, charging means for uniformly charging the electrophotographic photoreceptor, latent image forming means for forming a latent image on a surface of the charged electrophotographic photoreceptor, developing means for developing the latent image formed on the surface of the electrophotographic photoreceptor with a developer containing at least a toner to form a toner image, transferring means for transferring the toner image formed on the surface of the electrophotographic photoreceptor onto a toner image receiving body, and cleaning means for removing residual toner on the surface of the electrophotographic photoreceptor after the toner image has been transferred.

16. An image forming apparatus according to claim 15, wherein an average spherical index of the toner is from 100 to 140.

17. An image forming apparatus according to claim 15, wherein an exposure light source used in the latent image forming means is laser light having a wavelength of not more than 450 nm.

18. An electrophotographic photoreceptor comprising a conductive substrate, and at least one layer, which contains a polymeric compound having a repeating unit selected from repeating units represented by the following general formulas (II) or (III), provided on the conductive substrate, (II)

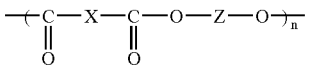

(III)

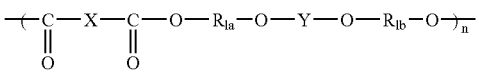

wherein in general formulas (II) or (III), $R_{1a}$ and $R_{1b}$ each independently represent an alkylene group having 1 to 6 carbon atoms, X represents a substituted or unsubstituted arylene group, or a substituted or unsubstituted alkylene group, Y is selected from the group of structures consisting of (IV), (V), (VI), (VII), (VIII), (IX), (X) and (XI), Z is selected from the group consisting of (VIII), (IX), (X) and (XI), and n represents a repeating unit number, (IV)

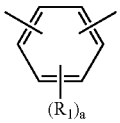

(V)

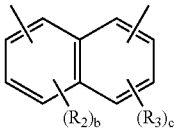

(VI)

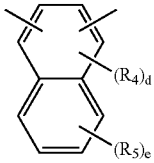

(VII)

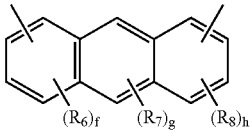

-continued (VIII)

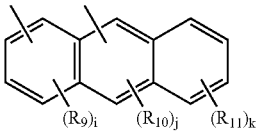

(IX)

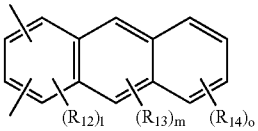

(X)

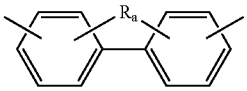

(XI)

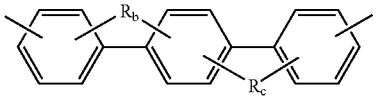

wherein in general formulas (IV) to (IX), $R_1$ to $R_{14}$ each independently represent an alkyl group having 1 to 10 carbon atoms, an aryl group having 6 to 14 carbon atoms, or a substituent containing silicon; a, e, k and o each independently represent an integer from 0 to 4; b, c, f, h and i each independently represent an integer from 0 to 3; d, g, 1 and m each independently represent an integer from 0 to 2; and j represents 0 or 1, in general formulas (X) and (XI), $R_a$ to $R_c$ each independently represent a substituted or unsubstituted alkylene group having 1 to 10 carbon atoms, or a divalent substituent containing silicon, and one or more of $R_a$, $R_b$ or $R_c$ may be present in a plurality in the respective formulas.

* * * * *